US009163894B1

(12) United States Patent
Reardon et al.

(10) Patent No.: US 9,163,894 B1
(45) Date of Patent: Oct. 20, 2015

(54) LASER TRANSMISSION SYSTEM FOR USE WITH A FIREARM IN A BATTLE FIELD TRAINING EXERCISE

(75) Inventors: Peter F. Reardon, Orlando, FL (US); Steven Gordon Preston, Winter Springs, FL (US); Edward Steve Kaprocki, Debary, FL (US); Kevin E. Keene, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1027 days.

(21) Appl. No.: 13/284,195

(22) Filed: Oct. 28, 2011

(51) Int. Cl.

| | |
|---|---|
| ***F41G 3/26*** | (2006.01) |
| ***F41A 33/00*** | (2006.01) |
| *F41A 33/02* | (2006.01) |
| *A63F 9/02* | (2006.01) |

(52) U.S. Cl.
CPC . *F41A 33/00* (2013.01); *A63F 9/02* (2013.01); *F41A 33/02* (2013.01); *F41G 3/26* (2013.01)

(58) Field of Classification Search
CPC ..... F41A 33/00; F41A 33/02; A63F 9/02; F41G 3/26
USPC ..... 434/19, 21; 273/393; 345/173
See application file for complete search history.

(56) References Cited

U.S. PATENT DOCUMENTS

| | | | | |
|---|---|---|---|---|
| 3,938,262 | A | 2/1976 | Dye et al. | |
| 4,063,368 | A | 12/1977 | McFarland et al. | |
| 4,315,689 | A | 2/1982 | Goda | |
| 4,487,583 | A | 12/1984 | Brucker et al. | |
| 4,561,849 | A | 12/1985 | Eichweber | |
| 4,662,845 | A | 5/1987 | Gallagher et al. | |
| 4,664,631 | A | 5/1987 | Pederson et al. | |
| 4,737,106 | A | 4/1988 | Laciny | |
| 5,119,576 | A * | 6/1992 | Erning | 42/117 |
| 5,426,295 | A | 6/1995 | Parikh et al. | |
| 5,476,385 | A * | 12/1995 | Parikh et al. | 434/22 |
| 5,605,461 | A | 2/1997 | Seeton | |
| 5,761,954 | A * | 6/1998 | Dvorak | 73/167 |
| 5,842,300 | A | 12/1998 | Cheshelski et al. | |
| 5,947,738 | A * | 9/1999 | Muehle et al. | 434/16 |
| 6,351,906 | B1 | 3/2002 | Honig, Jr. et al. | |
| 6,575,753 | B2 | 6/2003 | Rosa et al. | |
| 6,579,098 | B2 * | 6/2003 | Shechter | 434/21 |
| 6,638,070 | B1 * | 10/2003 | Healy et al. | 434/22 |
| 6,871,439 | B1 | 3/2005 | Edwards | |

(Continued)

OTHER PUBLICATIONS

Unknown, "M240B Machine Gun Operators Course," Jun. 2011, 120 pages.

(Continued)

*Primary Examiner* — Robert J Utama
(74) *Attorney, Agent, or Firm* — Withrow & Terranova, PLLC

(57) ABSTRACT

Laser transmission systems mountable on firearms are disclosed along with methods of operating and configuring the same. The laser transmissions systems are configured to detect that a sequence of real-time mechanical vibrations on the firearm are in accordance with a predetermined characteristic firing signature of the firearm. In response, the laser transmission system initiates transmission of a laser to simulate a munitions strike. The predetermined characteristic firing signature is based on a sequence of predetermined mechanical vibrations resulting from a first pre-flash firing event and a subsequent second pre-flash firing event. In this manner, the laser transmission system initiates transmission of the laser prior to a flash event and more accurately approximates a bullet trajectory.

25 Claims, 15 Drawing Sheets

(56) References Cited

U.S. PATENT DOCUMENTS

| | | | | |
|---|---|---|---|---|
| 6,887,079 | B1 | 5/2005 | Robertsson et al. | |
| 6,935,864 | B2 | 8/2005 | Shechter et al. | |
| 6,962,532 | B2 | 11/2005 | Hasebe et al. | |
| 7,576,311 | B2 | 8/2009 | Young | |
| 7,688,219 | B2 * | 3/2010 | Hudson et al. | 340/686.1 |
| 8,777,620 | B1 * | 7/2014 | Baxter | 434/16 |
| 2002/0057719 | A1 * | 5/2002 | Shechter | 372/16 |
| 2002/0197584 | A1 | 12/2002 | Kendir et al. | |
| 2003/0133598 | A1 * | 7/2003 | Recce | 382/115 |
| 2003/0175661 | A1 * | 9/2003 | Shechter et al. | 434/19 |
| 2004/0029080 | A1 * | 2/2004 | Healy et al. | 434/19 |
| 2006/0005447 | A1 * | 1/2006 | Lenner et al. | 42/111 |
| 2008/0032268 | A1 * | 2/2008 | Farrell et al. | 434/16 |
| 2008/0233543 | A1 * | 9/2008 | Guissin | 434/19 |
| 2009/0081619 | A1 * | 3/2009 | Miasnik | 434/21 |
| 2010/0192442 | A1 | 8/2010 | Carmel | |
| 2010/0203483 | A1 * | 8/2010 | Jones et al. | 434/21 |
| 2010/0221685 | A1 * | 9/2010 | Carter | 434/19 |
| 2014/0272808 | A1 * | 9/2014 | Guissin | 434/20 |

OTHER PUBLICATIONS

Unknown, "M240 7.62mm Armor Machine Gun," 5 pages, accessed Jun. 14, 2011, http://inetres.com/gp/military/cv/weapon/M240.html.

* cited by examiner

LASER TRANSMISSION SYSTEM FOR USE WITH A FIREARM IN A BATTLE FIELD TRAINING EXERCISE

FIELD OF THE DISCLOSURE

Embodiments disclosed herein relate generally to laser transmission systems, and in particular to laser transmission systems for use with a firearm in a battle field training exercise.

BACKGROUND

Militaries around the world use military combat training systems to help train military personnel for battle. To more realistically simulate battle conditions, military combat training systems have been developed that allow for the military personnel to use actual military equipment and weaponry during the battle field training exercises. Firearms used by participants in such battle field exercises may be mounted with laser transmission systems, and may also be loaded with blank munitions to closely simulate actual firing conditions. The laser transmission systems generate a laser that travels along an approximated bullet trajectory. Participants wear or otherwise carry a laser receiver system that registers a "hit" when struck by a laser.

Some automatic weapons used in such exercises depend on high pressures in the chamber generated by the combustion of the propellant to cycle the firearm and chamber the next round. If a blank munition is used, there is no bullet to seal the barrel, and the combustion gases exit through the muzzle without building up enough pressure to chamber the next round. In these circumstances a blank fire adaptor (BFA) is used. A BFA fits on the end of the barrel of a firearm and partially blocks the muzzle of the firearm, thereby causing sufficient pressure in the chamber to cycle the weapon and chamber the next round.

Some laser transmission systems initiate transmission of the laser based on a detected vibration of the firearm, such as the vibration associated with the discharge of the blank munition. Unfortunately, this enables a participant to "cheat" by causing the laser transmission system to initiate transmission of the laser by simply striking the firearm with an object. Other laser transmission systems initiate transmission of the laser using an acoustic sensor to detect the actuation of the trigger. The sensitivity levels needed to measure trigger actuation make these laser transmission systems vulnerable to noise and still enable a participant to cheat.

More recently, laser transmission systems have been developed that initiate transmission of the laser by measuring both the mechanical vibrations associated with a discharge of the munition and the subsequent sound or flash at the muzzle of the firearm caused by the discharge of the munition. Such subsequent sound or flash may be referred to herein as a "flash event." Delaying transmission of the laser until, or after, detection of the flash event greatly reduces, or eliminates, cheating by a participant.

Unfortunately, especially when a BFA is used, the forces associated with a flash event tend to cause the barrel of the firearm to skew, or deviate, from the direction it is aimed. Consequently, a laser transmission system used with a machine gun that includes a BFA, and that relies upon detection of the flash event to initiate transmission of the laser, necessarily initiates transmission of the laser after a point in time that the barrel has begun to deviate from the target due to the forces associated with the flash event. This deviation also causes the laser to deviate from the target, and may result in a "miss" rather than a "hit," even though the firearm was properly and accurately aimed at the target when the trigger was pulled. This sequence of events makes it difficult to assess the aiming accuracy of the participant.

In an attempt to compensate for transmitting the laser after the barrel has begun to deviate, manufacturers have increased laser power to increase the diameter of the bloom of the laser to increase the likelihood that the edge of the bloom will contact the laser receiver system. However, the increased laser diameter only partially compensates for the barrel deviation, and unfortunately the increase in laser power causes such laser systems to not be "eye-safe." Laser systems that are not eye-safe may not be practical in many training exercises, or may require additional protective material to be worn by participants, reducing the realism of the exercise.

Accordingly, there is a need for a laser transmission system that accurately approximates a bullet trajectory and prevents military personnel from initiating transmission of the laser without actually firing a munition.

SUMMARY

Those skilled in the art will appreciate the scope of the present disclosure and realize additional aspects thereof after reading the following detailed description of the preferred embodiments in association with the accompanying drawing figures.

This disclosure relates generally to laser transmission systems mountable on firearms for use in training exercises. The laser transmission system reduces, or renders impossible, the ability for a participant to initiate a laser transmission without actually firing the firearm, by conditioning the initiation of the laser on the detection of multiple predetermined sequences of vibrations associated with the firing of a round of ammunition. The laser transmission system maintains laser accuracy by ensuring that the transmission is initiated prior to a flash event so that the laser is transmitted in a direction that accurately represents how the firearm was aimed at the time the trigger was pulled.

In one embodiment, the laser transmission system includes a laser transmitter that transmits a laser to simulate a munitions strike from the firearm. When a munition is fired from the firearm, a sensing apparatus senses the sequence of real-time mechanical vibrations associated with a fired munition. A controller is operably associated with the sensing apparatus and configured to detect, or otherwise determine, that the sequence of real-time mechanical vibrations are in accordance with a predetermined characteristic firing signature of the firearm, and thus that firearm is actually being fired, and that the detected vibrations are not the result of a blow to the firearm. In response to such determination, the controller causes the laser transmitter to initiate transmission of the laser.

In one embodiment, the predetermined characteristic firing signature of the firearm is based on a sequence of predetermined mechanical vibrations resulting from a first pre-flash firing event and a subsequent second pre-flash firing event. Each pre-flash firing event is associated with the firing of a munition from the firearm and occurs prior to the flash event during the munition firing cycle of the firearm. As a result, the controller initiates transmission of the laser prior to the movements in firearm orientation resulting from the flash event so that the laser more accurately approximates a bullet trajectory. Furthermore, the controller inhibits the ability of military personnel to cheat because, to initiate transmission of the laser, the sequence of real-time mechanical vibrations have to be in accordance with the sequence of predetermined mechanical vibrations in the predetermined characteristic firing signature resulting from at least two pre-flash firing events associated with the firing of a munition.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Military combat training systems allow actual military equipment and weapons to be used by military personnel during a battle field training exercise. This provides the military with a more realistic training environment so that the battle performance of military personnel can be more accurately determined. To simulate a battle, military personnel and/or vehicles are provided with a laser receiver system and weapons strikes are simulated by the transmission of lasers. If the laser receiver system is illuminated by one or more of these lasers, the laser receiver system determines whether to register a "kill."

The embodiments disclosed herein relate generally to laser transmission systems mountable on firearms and methods of operating and configuring the same. Embodiments of the laser transmission systems may be mounted on the firearm and transmit a laser to simulate munition strikes when a munition, such as a blank munition, is fired from the firearm. In this manner, the laser receiver systems employed by the military combat training system may be illuminated by the laser and determine whether to register a "kill".

Embodiments of the laser transmission systems disclosed herein initiate transmission of the laser prior to a flash event. Accordingly, the laser more accurately simulates a munition strike since the laser is initiated prior to the changes in orientation resulting from the mechanical vibrations of the flash event. Thus, unlike prior laser transmission systems, the gun operator's inability to hit a target during a battle field training exercise can no longer be blamed on the gun jump resulting from the flash event. Therefore, the performance of military personnel can be more accurately judged from the battle field training exercise. The laser transmission systems and methods are particularly beneficial for use with firearms, such as bolt-back machine guns, that experience significant forces and mechanical vibrations during flash events.

Figure 1:
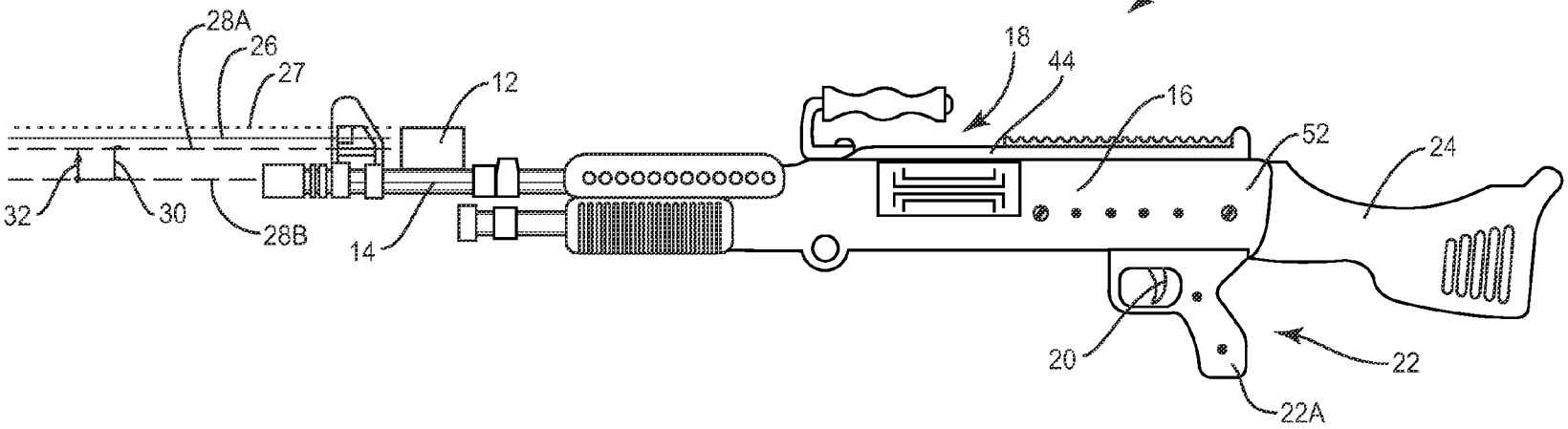
FIG. 1 illustrates one embodiment of an M240 machine gun.

FIG. 1 illustrates one embodiment of a firearm 10 and a laser transmission system 12 mounted on the firearm 10. In this embodiment, the firearm 10 is a bolt-back machine gun and, in particular, a M240 machine gun. The firearm 10 has a barrel 14, receiver assembly 16, a feed assembly 18, a trigger 20, a trigger housing assembly 22, and a butt stock 24. The receiver assembly 16 houses a firing mechanism that operates to discharge munitions placed within a chamber of the firearm 10. The firing mechanism of a bolt-back machine gun, such as the M240 machine gun, typically includes a spring apparatus. To fire a munition from the firearm 10, bolt-back machine guns need to place the firing mechanism in a fire ready position. Initially, a gun operator may place the firing mechanism in a fire ready position by pulling the firing mechanism toward the back of the firearm 10. This compresses the spring apparatus and the firing mechanism is held in place by the trigger 20 or a mechanism associated with the trigger 20.

The trigger housing assembly 22 houses the trigger 20 and includes a handle 22A that allows a gun operator to grip the firearm 10. To begin firing munitions, the gun operator pulls the trigger 20. The actuation of the trigger 20 releases the firing mechanism and the firing mechanism is propelled forward by the energy from the compressed spring apparatus. The firing mechanism then strikes the munition within the chamber of the firearm to discharge the munition. The butt stock 24 attaches to the receiver assembly 16 and helps the gun operator absorb the recoil from the firearm 10 caused by the discharge of the munition.

In gas-operated automatic machine guns, such as the M240 machine gun, the gases propelled by the discharge of the munition are fed back to force the firing mechanism back into the fire ready position. The spring apparatus is thereby again compressed. During automatic fire, the cycle is repeated as long as the trigger 20 remains depressed and munitions are available to be fired. In other types of firearms 10, such as semi-automatic firearms, the trigger 20 may need to be pulled to fire each munition.

Munitions include a cartridge and a propellant, such as gun powder, enclosed within the cartridge. Live munitions typically also include a bullet, while blank munitions do not include a bullet. When live munitions are fired by the firearm 10, the bullet is propelled by the discharge of the munition through the barrel 14. The trajectory followed by the bullet depends on the orientation of the firearm 10 when the bullet is exiting the barrel 14. Typically, blank munitions are fired from the firearm 10 during battle field training exercises. The laser transmission system 12 may be mounted on the firearm 10 to transmit a laser 26 along a transmission path 28A. The transmission path 28A may approximate a bullet trajectory 28B. In this embodiment, the laser transmission system 12 is mounted on the barrel 14 of the firearm 10 and the laser 26 is transmitted in a direction substantially parallel to the barrel 14 and a line of sight 27 of the firearm 10. However, alternative embodiments of the laser transmission system 12 are mountable on other parts of the firearm 10, such as for example, the receiver assembly 16.

The transmission path 28A approximates the bullet trajectory 28B but does not necessarily have to exactly follow the bullet trajectory 28B to accurately simulate munition strikes from the firearm 10. While the transmission path 28A is substantially parallel to the barrel 14, the transmission path 28A and the bullet trajectory 28B may not be substantially parallel since the laser 26 may be initiated and transmitted before and/or after a bullet would be exiting the barrel 14. This may depend on the timing for initiating and duration of laser transmission. Also, due to the recoil of some firearms 10, the transmission path 28A may not be static. Instead, the transmission path 28A may fluctuate due to the mechanical vibrations that result from firing the munition. Consequently, the transmission path 28A of laser 26 and the bullet trajectory 28B may not be substantially parallel but rather cross after a distance from the firearm 10. In fact, after great distances the transmission path 28A and the bullet trajectory 28B typically have to diverge since the laser 26 may follow a somewhat linear path while the bullet trajectory 28B is hyperbolic since the bullet eventually falls back to earth. Furthermore, even when the transmission path 28A is maintained substantially parallel to the bullet trajectory 28B, the transmission path 28A may not be coaxial with the bullet trajectory 28B.

However, the transmission path 28A of the laser 26 does not have to exactly follow, be substantially parallel to, or remain static relative to the bullet trajectory 28B in order for the laser 26 to accurately simulate a munition strike from the firearm 10. Rather, the transmission path 28A approximates the bullet trajectory 28B so long as a distance 30 from a normal 32 of the bullet trajectory 28B is maintained within an acceptable error range in accordance with the requirements of the military combat training system. What error ranges are acceptable may depend on factors such as the accuracy required by a particular type of military combat training system, the firing specifications of the firearm 10, the design of the military combat training system or the battle field training exercises implemented using the military combat training system, and/or the particular circumstances in which the firearm 10 may be used in the particular battle field training exercise.

The transmission path 28A does not have to approximate the bullet trajectory 28B the entire time that the laser 26 is being transmitted from the laser transmission system 12 to accurately simulate a munitions strike. Rather, the transmission path 28A simply needs to approximate the bullet trajectory 28B long enough for a laser receiver system to register a "kill." The laser transmission system 12 initiates transmission of the laser 26 prior to a flash event to help ensure that the munition strikes from the firearm accurately reflect the bullet trajectory 28B long enough to register a "kill."

Figure 2A:
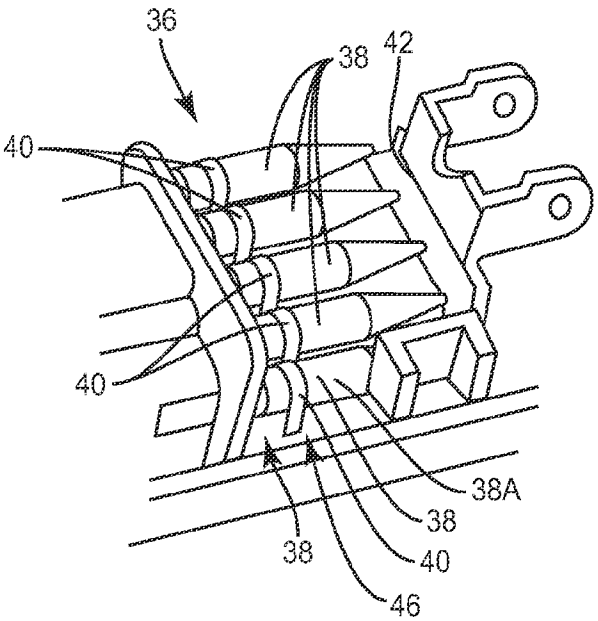
FIGS. 2A and 2B illustrate one embodiment of a firing mechanism, feed tray, and a munitions belt for the M240 machine gun shown in FIG. 1.
Figure 2B:
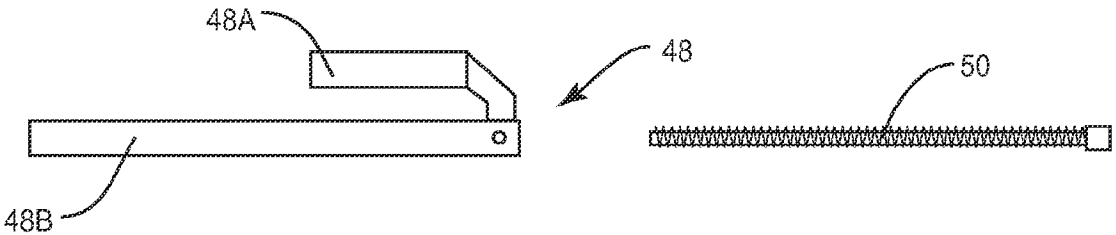

Referring now to FIGS. 1, 2A, and 2B, FIGS. 2A and 2B illustrate one embodiment of a firing mechanism 34 of the firearm 10 and portions of the feed assembly 18 (shown in FIG. 1). The M240 machine gun is fed from a belt 36 of munitions 38. Each munition 38 is a blank munition and has been placed in a link 40 of the belt 36. Other embodiments of the firearm 10 may be fed from clips, magazines, and the like. The feed assembly 18 has a feed tray 42 and a cover assembly 44 (shown in FIG. 1). Both the feed tray 42 and the cover assembly 44 are movably attached to the receiver assembly 16 (shown in FIG. 1) To load the firearm 10, the gun operator first lowers the feed tray 42 onto the receiver assembly 16 and places the first munition 38A in the belt 36 within a tray groove 46 formed in the feed tray 42. The remainder of the belt 36 is then laid across the feed tray 42 and then the cover assembly 44 of the feed mechanism is lowered onto the feed tray 42.

The firing mechanism 34 is housed within the receiver assembly 16 (FIG. 1) and includes a bolt/operating rod assembly 48 and a spring rod 50 receivable by the bolt/operating rod assembly 48. The bolt/operating rod assembly 48 includes a bolt 48A and an operating rod 48B movably connected to one another. In this example, the M240 machine gun (FIG. 1) is a bolt-back machine gun. After the M240 machine gun has been loaded, the gun operator may pull a cocking handle (not shown) to position the firing mechanism 34 toward a back end 52 (FIG. 1) of the receiver assembly 16. In this manner, the spring rod 50 is compressed and the firing mechanism 34 is placed in a fire ready position. The bolt/operating rod assembly 48 may have a sear and the trigger 20 that forms a sear notch. To hold the firing mechanism 34 in the fire ready position, the sear of the bolt/operating rod assembly 48 inserts into the sear notch of the trigger 20. The bolt-back machine gun is ready to be fired.

The gun operator may now begin firing munitions 38 from the firearm 10. The firearm 10 accomplishes the firing of munitions 38 via a sequence of firing actions. A firing action is any action that is performed by the various components of the firearm 10 during a munitions firing cycle. Exemplary firing actions of the M240 machine gun are listed below. Note however that the firing actions do not necessarily occur in a mutually exclusive sequence but may partially overlap one another.

1. Trigger pull action. The trigger pull action is the actuation of the trigger 20. Generally, the trigger pull action is caused when the gun operator pulls the trigger 20. For the M240 machine gun, actuating the trigger 20 releases the sear in the bolt/operating rod assembly 48 from the sear notch in the trigger 20. This allows the bolt/operating rod assembly 48 to be driven forward by the force of the spring rod 50.

2. Munition Stripping Action. The munition stripping action strips a munition 38 from the belt 36 and pushes a link 40 in the belt 36 out the side of the firearm 10. In the M240 machine gun, feed pawls within the cover assembly 44 position the munition 38. The bolt 48A then engages the munition 38. The forward movement of the bolt/operating rod assembly 48 strips the munition 38 from the belt 36 and pushes the link 40 of a fired round out the side of the M240 machine gun.

3. Chambering Action. The chambering action places the munition 38 within a chamber of the firearm 10. In the M240 machine gun, the bolt 48A continues to engage the munition 38 and a chambering ramp in the feed tray 42 guides with munition 38 into the chamber as the bolt/operating rod assembly 48 continue to be propelled forward.

4. Locking Action. The locking action stops the forward movement of the bolt 48A while allowing the operating rod 48B to continue moving forward. The bolt 48A is stopped in the M240 machine gun when a locking lever on the bolt 48A is placed within a breech formed by the barrel 14. The barrel 14 and the breech of the M240 machine gun do not actually interlock but rather the locking lever is simply placed in the breech to stop the movement of the bolt 48A.

5. Munition Discharge Action. A munition discharge action discharges the munition 38 within the chamber of the firearm 10. With regards to the M240 machine gun, a firing pin is provided within the bolt 48A. While the bolt 48A has been stopped by the breech in the barrel 14, the firing pin is driven forward by the operating rod 48B and strikes the munition 38. This ignites the gun powder within the munition 38 to discharge the munition 38.

6. Unlocking Action. To complete the munition firing cycle, the firing mechanism 34 needs to be placed back into the fire ready position. This begins when the unlocking action frees the bolt 48A so that the bolt 48A may move rearward. For the M240 machine gun, gases propelled by the discharge munition 38 are fed back from a gas plug regulator in the barrel 14 to a gas cylinder that drives a gas propelled piston. The rapidly expanding gases drive the gas piston to force the bolt/operating rod assembly 48 to the rear. During the primary movement, the operating rod 48B moves independently of the bolt 48A for a short distance. At this point, the locking lever begins to swing toward the rear, carrying the bolt 48A with it into its unlocked position, and clearing the breech in the barrel 14. For gas operated machine guns, such as the M240 machine gun, the force from this gas is what drives the firing mechanism 34 back to its original fire ready position.

7. Extraction Action. The extraction action removes the empty case of the discharged munition 38 from the chamber. After the unlocking action in the M240 machine gun, the empty case from the discharged munition 38 is withdrawn from the chamber by an extractor.

8. Ejecting Action. The ejecting action ejects the empty case from the firearm 10. With regards to the M240 machine gun, an ejector pushes from the top and the extractor pulls from the bottom to push the empty case from an ejection port in the firearm 10.

9. Cocking Action. The cocking action completes the return of the firing mechanism 34 to the fire ready position. In the M240 machine gun, sufficient gas is made available to the gas cylinder to move the bolt/operating rod assembly 48 toward the back end 52 of the receiver assembly 16. This compresses the spring rod 50 until the firing mechanism 34 is back in the fire ready position and ready to fire the next munition 38.

A flash event occurs during the munition firing cycle when a flash of gas propelled by the munition discharge action exits the barrel 14 of the firearm 10. The flash of gas has typically been heated by the munition discharge action and may be associated with an electromagnetic discharge that exits the barrel 14 as a result of the heated gas. The flash event occurs for the M240 machine gun subsequent to the trigger pull action, the munition stripping action, the chambering action, the locking action, and the munition discharge action.

Note that the M240 machine gun provides automatic fire and the trigger pull action occurs during the initial munition firing cycle. Subsequent munition firing cycles after the initial firing cycle do not include a trigger pull action but rather the energy provided by the discharge of the munition 38 returns the firing mechanism 34 to the fire ready position, thereby compressing the spring rod 50. As long as the trigger 20 remains depressed and there are available unspent munitions 38 in the belt 36, firing actions 2-9 are repeated during the subsequent munition firing cycles to automatically fire munitions 38 from the firearm 10. Thus, the munition stripping action, the chambering action, the locking action, and the munition discharge action occur prior to the flash event in subsequent munition firing cycles associated with the firing of subsequent munitions 38. To stop automatic fire, the M240 machine gun operator releases the trigger 20 and a trigger return action places the sear of the bolt/operating rod assembly 48 within the sear notch of the trigger 20. This holds the firing mechanism 34 in the fire ready position and prevents another munition firing cycle from taking place. The gun operator may automatically fire the firearm 10 again. During automatic fire, another initial munition firing cycle is again followed by additional subsequent munition firing cycles.

The above-recited firing actions are simply exemplary and the firing actions implemented by the munition firing cycle of different types of firearms 10 are dependent on the particular mechanisms employed by that particular firearm 10. The above-recited firing actions may or may not be applicable depending on the type of firearm 10 and the mechanisms employed by the firearm 10. For example, the munition stripping action described above is not applicable to firearms 10 fed from clips or magazines and thus clip or magazine fed firearms 10 may involve different kinds of firing actions to feed the firearm 10. Also, the locking action and unlocking action may not be applicable to other firearms 10 depending on the particular firing mechanism 34 being utilized by the firearm 10. Other firearms 10, such as semi-automatic firearms 10, may require a trigger pull action for every munition firing cycle.

Even if one of the above-recited firing actions is applicable to a particular firearm 10, the firing action may take place in a different order than the order recited above. For instance, in forward bolt machine guns, the munition 38 is already in the chamber when the trigger 20 is pulled and thus the chambering action may take place after the munition discharge action. In addition, the implementation of the above-recited firing actions may be dependent on particular mechanisms utilized by the firearm 10. To demonstrate, in recoil-based machine gun systems, the firing mechanism 34 is not gas propelled but rather is the result of the recoil force that pushes the gun backwards. This disclosure is not limited to any particular type of firearm 10 or set of firing mechanisms 34 since the laser transmission systems 12 and methods disclosed herein may be utilized to more accurately reflect munitions strikes from any type of firearm 10.

Figure 3:
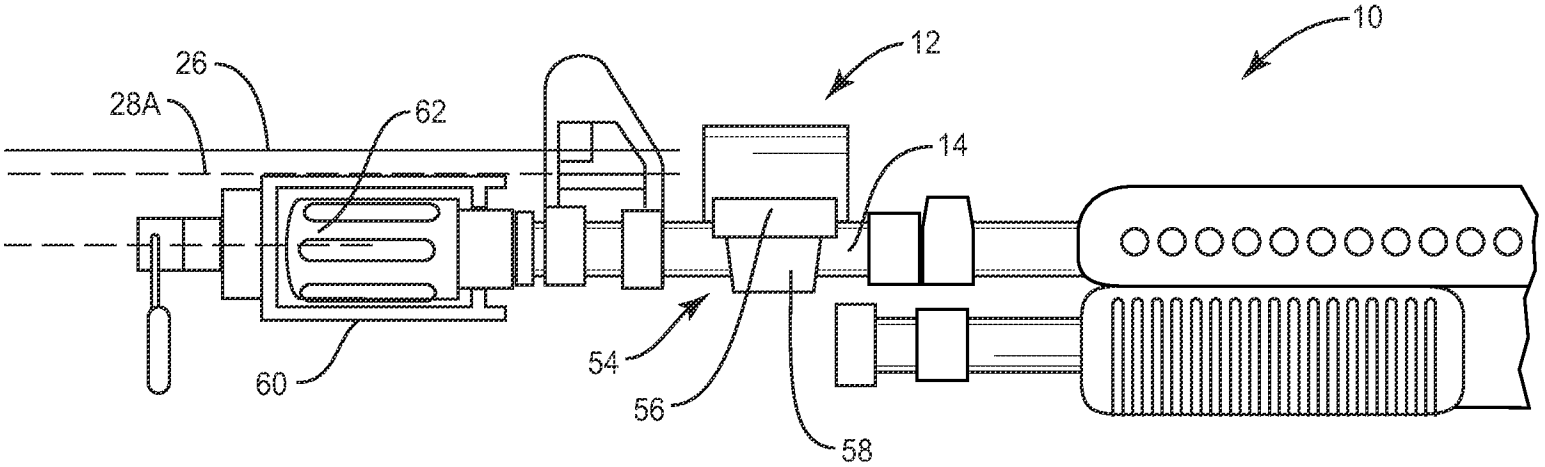
FIG. 3 illustrates one embodiment of a laser transmission system and a blank fire adaptor mounted on a barrel of the M240 machine gun shown in FIG. 1.

Referring now to FIGS. 1 and 3, FIG. 3 illustrates one embodiment of the laser transmission system 12 mountable on the barrel 14 of the firearm 10. The laser transmission system 12 in the embodiment shown in FIG. 3 is for the M240 machine gun. In this particular embodiment, the laser transmission system 12 has a mounting apparatus 54 that has been mounted on the laser transmission system 12 so that the orientation of the transmission path 28A is substantially parallel to the barrel 14. The mounting apparatus 54 in FIG. 3 has a mounting body 56 shaped to receive the barrel 14 and a securement section 58 that attaches underneath the mounting body 56 through screws or the like to removably secure the laser transmission system 12 to the firearm 10. Adjustment mechanisms and the like may be provided to adjust the angle of the laser 26 relative to the barrel 14 if desired.

However, any suitable mechanism may be employed to mount the laser transmission system 12 to the firearm 10. For example, the laser transmission system 12 may have a mounting apparatus 54 that allows for the laser transmission system 12 to be welded or integrated into the firearm 10. Furthermore, other embodiments of the mounting apparatus 54 may be utilized to mount the laser transmission system 12 to other parts of the firearm 10, such as the receiver assembly 16.

The laser transmission system 12 has been configured so that the firearm 10 may be employed in a military combat training system. A laser 26 is initiated each time a munition 38 is fired from the firearm 10 to simulate a munition strike. Typically, the munitions 38 fired during battle field training exercises are blank munitions. Often, discharges from blank munitions do not provide the necessary forces to complete the munition firing cycle. As a result, the barrel 14 of the firearm 10 may be fitted with a blank fire adaptor 60. The blank fire adaptor 60 increases the energy provided to cycle the firearm 10 by partially blocking an exit end 62 of the barrel 14. In this manner, the M240 machine gun is configured to automatically fire blank munitions during battle field training exercises. For gas-operated machine guns, like the M240 machine gun, the blank fire adaptor 60 causes gas to escape the exit end 62 of the barrel 14 at a much slower rate. The obstructed gas increases the pressure within the barrel 14 and allows the firearm 10 to cycle. Embodiments of the blank fire adaptor 60 may be provided to allow for gas flow rate adjustments so that the gun operator can adjust the amount of gas pressure within the barrel 14. Recoil operated machine guns may also be adapted for gas-operation and provided with the blank fire adaptor 60. Other embodiments of the blank fire adaptor 60, such as muzzle boosters, may be provided to add more energy to the recoiling parts of the firearm 10.

While firearms 10 generally fire blank munitions during battle field training exercises, embodiments of the laser transmission system 12 may be configured to operate with other types of munitions 38. For example, the laser transmission system 12 may be designed to operate with specialized munitions 38 designed to fire non lethal projectiles simply to create the necessary forces to cycle the firearm 10. Furthermore, military combat training systems may allow for live rounds to be fired in battle field training exercises under the appropriate safety conditions. Embodiments of the laser transmission system 12 may be designed to simulate munition strikes, even when live ammunition is being fired in a battle field training exercise, because the laser transmission system 12 and laser receiver system may allow for electronic data to be recorded.

Figure 4:
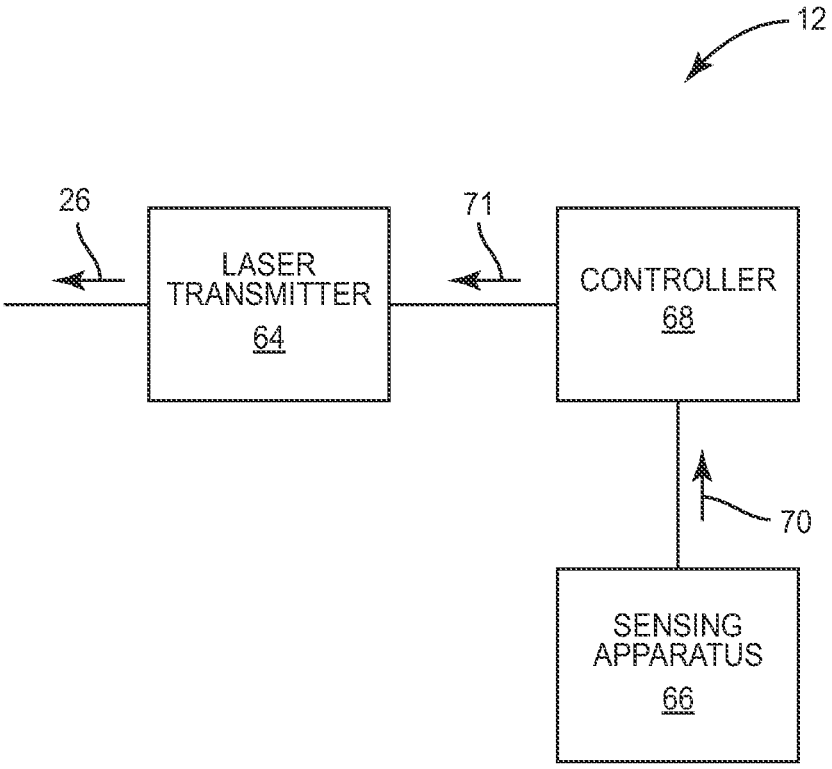
FIG. 4 illustrates a block diagram of the laser transmission system shown in FIG. 3.

FIG. 4 illustrates a block diagram of one embodiment of the laser transmission system 12. The laser transmission system 12 includes a laser transmitter 64 operable to transmit the laser 26, a sensing apparatus 66, and a controller 68 operably associated with the laser transmitter 64 and the sensing apparatus 66. The sensing apparatus 66 may be any type of sensing apparatus 66 operable to sense a sequence of real-time mechanical vibrations of the firearm 10. For example, the sensing apparatus 66 may be one or more piezoelectric sensors or accelerometers. The controller 68 is configured to detect whether the sequence of real-time mechanical vibrations sensed by the sensing apparatus 66 are in accordance with a predetermined characteristic firing signature of the firearm. The predetermined characteristic firing signature is based on a sequence of predetermined mechanical vibrations associated with the firing of a munition from the firearm. If the controller 68 detects that the sequence of real-time mechanical vibrations are in accordance with the predetermined characteristic firing signature, it is very likely that the sequence of real-time mechanical vibrations have been caused by a munition being fired in real-time by the firearm. Thus, in response to detecting that the sequence of real-time mechanical vibrations are in accordance with the predetermined characteristic firing signature, the controller 68 is configured to initiate transmission of the laser 26 from the laser transmitter 64.

When firing live munitions, the flash event occurs after the bullet has left the muzzle. Consequently, barrel skew caused by the flash event does not reflect the accuracy of the bullet. Initiating laser transmission after the flash event, on the other hand, causes the laser to be initiated after, or during, barrel skew, thereby resulting in a laser being transmitted in a direction that differs from the direction the firearm was aimed at the time the trigger was pulled.

To more accurately reflect munition strikes from the firearm, the predetermined characteristic firing signature is based on a sequence of predetermined mechanical vibrations that occur prior to the flash event. In particular, the predetermined characteristic firing signature is based on a sequence of predetermined mechanical vibrations resulting from at least a first pre-flash firing event and a subsequent second pre-flash firing event. If the sequence of real-time mechanical vibrations is detected, or otherwise determined, to be in accordance with the predetermined characteristic firing signature the laser is transmitted.

A firing event is a firing action, combination of firing actions, or other occurrence, that causes detectable or sensible mechanical vibrations of the firearm during the munitions firing cycle of a firearm. For example, one example of a firing event is the flash event that occurs during the munitions firing cycle of the firearm, as explained above. However, unlike the flash event, a pre-flash firing event takes place during the munitions firing cycle prior to the flash event. Since a pre-flash firing action is an occurrence that takes place prior to the flash event during a munitions firing cycle and is associated with the firing of a munition from the firearm, a pre-flash firing action is a type of pre-flash firing event. For example, the trigger pull action, the munition stripping action, the chambering action, the locking action, and the munition discharge action are each pre-flash firing events.

The predetermined characteristic firing signature may be based on the sequence of predetermined mechanical vibrations from any first pre-flash firing event and any subsequent second pre-flash firing event, so long as the predetermined mechanical vibrations of the first pre-flash firing event and the predetermined mechanical vibrations of the second pre-flash firing event each define discrete mechanical impulse responses. For example, the predetermined characteristic firing signature may be based on the sequence of predetermined mechanical vibrations resulting from the trigger pull action and the subsequent chambering action. In another embodiment, the predetermined characteristic firing signature may be based on the sequence of predetermined mechanical vibrations resulting from the trigger pull action and the subsequent munition discharge action. In yet another embodiment, the predetermined characteristic firing signature may be based on the sequence of predetermined mechanical vibrations resulting from the trigger pull action and the subsequent munition stripping action.

A pre-flash firing event may also be a combination of pre-flash firing actions. Thus, the predetermined characteristic firing signature may be based on the sequence of predetermined mechanical vibrations resulting from a first pre-flash firing action and a combination of subsequent pre-flash firing actions so long as the predetermined mechanical vibrations resulting from the first pre-flash firing action and the combination of subsequent pre-flash firing actions define discrete mechanical impulse responses. For example, the combination of the munition stripping action and the chambering action may be combined to define a pre-flash firing event. The predetermined mechanical vibrations resulting from the combination of the munition stripping action and the chambering action define a discrete mechanical impulse response relative to the predetermined mechanical vibrations resulting from the trigger pull action. Thus, in one embodiment, the predetermined characteristic firing signature is based on the sequence of predetermined mechanical vibrations resulting from the trigger pull action, as the first pre-flash firing event, and the combination of the munition stripping action and the chambering action, as the subsequent second pre-flash firing event.

One of the two pre-flash firing events can also be an occurrence that takes place within a particular firing action prior to the flash event so long as the predetermined mechanical vibrations resulting from the pre-flash firing event define a discrete mechanical impulse response relative to the predetermined mechanical vibrations resulting from the other of the two pre-flash firing events. For instance, as discussed above, gases are fed back from a gas plug regulator in the barrel to a gas cylinder during the unlocking action of the M240 machine gun. While gases may continue to flow through the gas plug regulator after the flash event, the gases are initially received during the unlocking action by the gas plug regulator prior to the flash event. Thus, the predetermined characteristic firing signature may be based on the sequence of predetermined mechanical vibrations resulting from the chambering action, as the first pre-flash firing event, and the gases of the firearm initially reaching the gas cylinder, as the subsequent second pre-flash firing event.

Since the predetermined characteristic firing signature is based on the predetermined mechanical vibrations of at least a first pre-flash firing event and a second subsequent pre-flash firing event, the controller 68 detects that the real-time mechanical vibrations are in accordance with the predetermined characteristic firing event signature prior to the flash event. In this manner, the controller 68 initiates transmission of the laser 26 before the changes in orientation caused by the flash event. Furthermore, the controller 68 prevents the gun operator from "cheating", because the predetermined characteristic firing signature is based on the predetermined mechanical vibrations resulting from multiple pre-flash firing events.

In the embodiment illustrated in FIG. 4, the sensing apparatus 66 generates sequences of real-time electronic responses 70 based on sensed real-time mechanical vibrations. The controller 68 is coupled to the sensing apparatus 66 and receives the real-time electronic responses 70 from the sensing apparatus 66. The controller 68 uses the real-time electronic responses 70 to detect whether the real-time mechanical vibrations are in accordance with the predetermined characteristic firing signature of the firearm. In this embodiment, the controller 68 is configured to generate a laser initiation signal 71 upon detecting that the sequence of real-time mechanical vibrations are in accordance with the predetermined characteristic firing signature. The laser initiation signal 71 is operable to cause the laser transmitter 64 to initiate transmission of the laser 26.

The controller 68 may have any type of suitable configuration to detect that the sequence of real-time mechanical vibrations are in accordance with the predetermined characteristic firing signature. As explained in further detail below, the control device(s) used by the controller 68 may depend on the type of sensing apparatus 66 being utilized to sense the sequence of real-time mechanical vibrations and the manner in which the controller 68 detects that the sequence of real-time mechanical vibrations are in accordance with the predetermined characteristic firing signature of the firearm.

Figure 5:
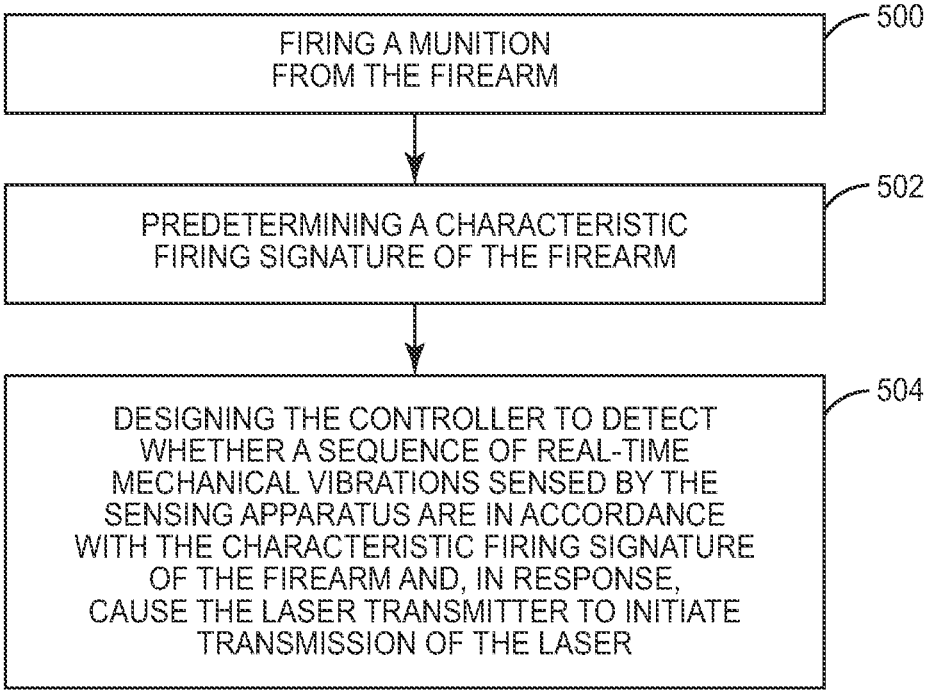
FIG. 5 illustrates exemplary procedures for designing a controller in the laser transmission system shown in FIG. 4.

Referring now to FIGS. 4 and 5, FIG. 5 illustrates one embodiment of exemplary procedures for designing the controller 68 of the laser transmission system 12. The embodiment of the exemplary procedures of FIG. 5 design the controller 68 shown in FIG. 4 to operate with the M240 machine gun illustrated in FIG. 1. However, different embodiments of the exemplary procedures of FIG. 5 may be implemented to design different types of controllers 68. The controller 68 may be hardware based and/or software based. The controller 68 may also be designed for a particular firearm, munition type, sensing apparatus 66, military combat training system, and/or battle field training exercise.

To begin, a munition is fired from the firearm (procedure 500). The munition is fired to determine the characteristic firing signature of the firearm. A sensing apparatus is provided on the firearm to sense the mechanical vibrations of the firearm that result from firing the munition. The sensing apparatus used in exemplary procedure 500 may be the same type of sensing apparatus in the laser transmission system 12 of FIG. 4, or alternatively, a different type of sensing apparatus. The sensing apparatus generates a sequence of electronic responses based on the mechanical vibrations that result from firing the munition from the firearm. A characteristic firing signature of the firearm is then predetermined based on the sequence of mechanical vibrations that result from a first pre-flash firing event and a second pre-flash firing event (procedure 502). The controller 68 is then designed to detect whether a sequence of real-time mechanical vibrations sensed by the sensing apparatus 66, shown in FIG. 4, is in accordance with the characteristic firing signature of the firearm and, in response, cause the laser transmitter 64 to initiate transmission of the laser 26 (procedure 504).

Figure 6:
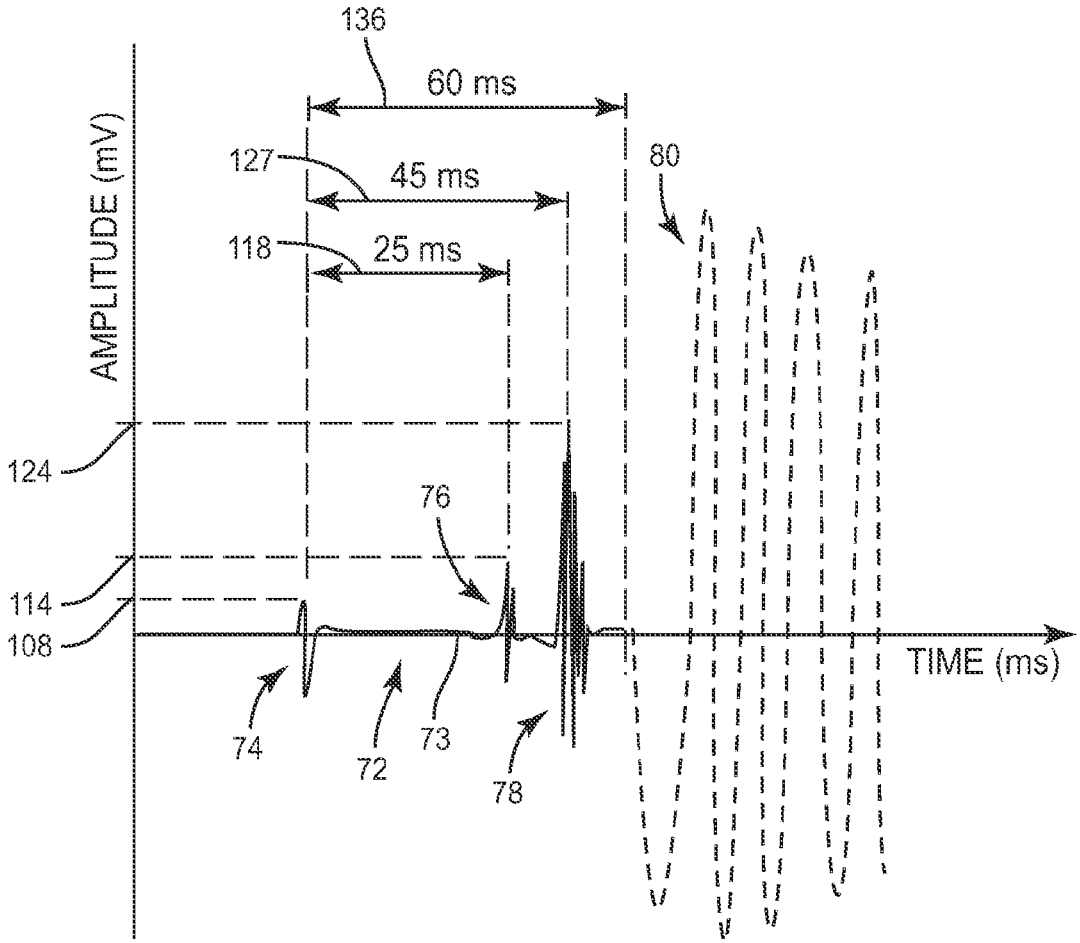
FIG. 6 illustrates one embodiment of a predetermined characteristic firing signature for the M240 machine gun shown in FIG. 1.

Referring now to FIGS. 4 and 6, FIG. 6 illustrates one embodiment of a predetermined characteristic firing signature 72 that was predetermined in accordance with the exemplary procedure 502 of FIG. 5 using piezoelectric sensors based on firing the munition from the firearm in accordance with exemplary procedure 500 of FIG. 5. The predetermined characteristic firing signature 72 is based on predetermined mechanical vibrations resulting from firing a blank munition from the M240 machine gun with the blank fire adaptor 60 fitted on the exit end 62 of the barrel 14, as shown in FIG. 3. The predetermined characteristic firing signature 72 is a sequence of predetermined electronic responses 73 corresponding to the sequence of predetermined mechanical vibrations resulting from the pre-flash firing events of the M240 machine gun during a munitions firing cycle. A first set 74 of predetermined electronic responses 73 correspond to the sequence of predetermined mechanical vibrations resulting from the trigger pull action, a second set 76 of predetermined electronic responses 73 correspond to the sequence of predetermined mechanical vibrations resulting from the chambering action, and a third set 78 of the predetermined electronic responses 73 corresponds to the sequence of predetermined mechanical vibrations resulting from the munition discharge action. Thus, the first set 74 of the predetermined electronic responses 73 is a characteristic firing event signature of the trigger pull action, the second set 76 of the predetermined electronic responses 73 is a characteristic firing event signature of the chambering action, and the third set 78 of the predetermined electronic responses 73 is a characteristic firing event signature of the munition discharge action. The set 80 of electronic responses are not part of the predetermined characteristic firing signature 72 and are not included within the predetermined electronic responses 73 but rather represent the set 80 of electronic responses that result from the flash event. Consequently, the first set 74, the second set 76, and the third set 78 of predetermined electronic responses 73 each result from predetermined mechanical vibrations associated with pre-flash firing events, in this case pre-flash firing actions associated with the firing of the munition from the firearm.

As mentioned above, the predetermined characteristic firing signature 72 is based on a sequence of predetermined mechanical vibrations that result from at least a first pre-flash firing event and a subsequent second pre-flash firing event. In one embodiment, to detect that a sequence of real-time mechanical vibrations are in accordance with the predetermined characteristic firing signature 72 of the firearm, the controller 68 is configured to detect that the sequence of real-time mechanical vibrations are in accordance with the first set 74 of predetermined electronic responses 73 and the second set 76 of predetermined electronic responses 73. In this manner, the controller 68 is configured to detect that a sequence of real-time mechanical vibrations result from the trigger pull action and the chambering action. In response, the controller 68 initiates transmission of the laser 26.

The predetermined characteristic firing signature 72 may be utilized to determine the real-time pre-flash firing events that cause initiation of the laser 26 based on any suitable combination of predetermined pre-flash firing events. For example, in an alternative embodiment, to detect that a sequence of real-time mechanical vibrations are in accordance with the predetermined characteristic firing signature 72 of the firearm, the controller 68 may be configured to detect that the real-time mechanical vibrations are in accordance with the first set 74 of electronic responses and the third set 78 of predetermined electronic responses 73. The controller 68 may thus be configured to detect a sequence of real-time mechanical vibrations that result from the trigger pull action and the munition discharge action when a munition is fired in real-time. In yet another alternative, all three sets 74, 76, 78 of predetermined electronic responses 73 may be utilized to detect that the sequence of real-time mechanical vibrations are in accordance with the predetermined characteristic firing signature 72.

As shown in FIG. 6, the first set 74, the second set 76, and the third set 78 of predetermined electronic responses 73 all occur prior to the set 80 of electronic responses representing the mechanical vibrations of the flash event. As a result, if the controller 68 detects that the sequence of real-time mechanical vibrations is in accordance with the predetermined characteristic firing signature 72 of the firearm, transmission of the laser 26 is initiated prior to the flash event.

Embodiments of the controller 68 may be configured to detect that the real-time electronic vibrations are in accordance with predetermined characteristic firing signature 72 based on predetermined mechanical vibrations of other pre-flash firing events as well. For example, the predetermined characteristic firing signature 72 may be based on pre-flash firing events such as the munition stripping action or the locking action. In addition, predetermined characteristic firing signatures, such as the predetermined characteristic firing signature 72 in FIG. 6, may be predetermined for any type of firearm to design the controller 68 to detect the particular mechanical vibrations resulting from pre-flash firing actions of the particular firearm and initiate transmission of the laser 26. In this manner, the controller 68 is configured to detect the firing of munitions by the firearm during the battle field training exercises so that the laser 26 can be used to simulate real-time munition strikes from the firearm.

Figure 7:
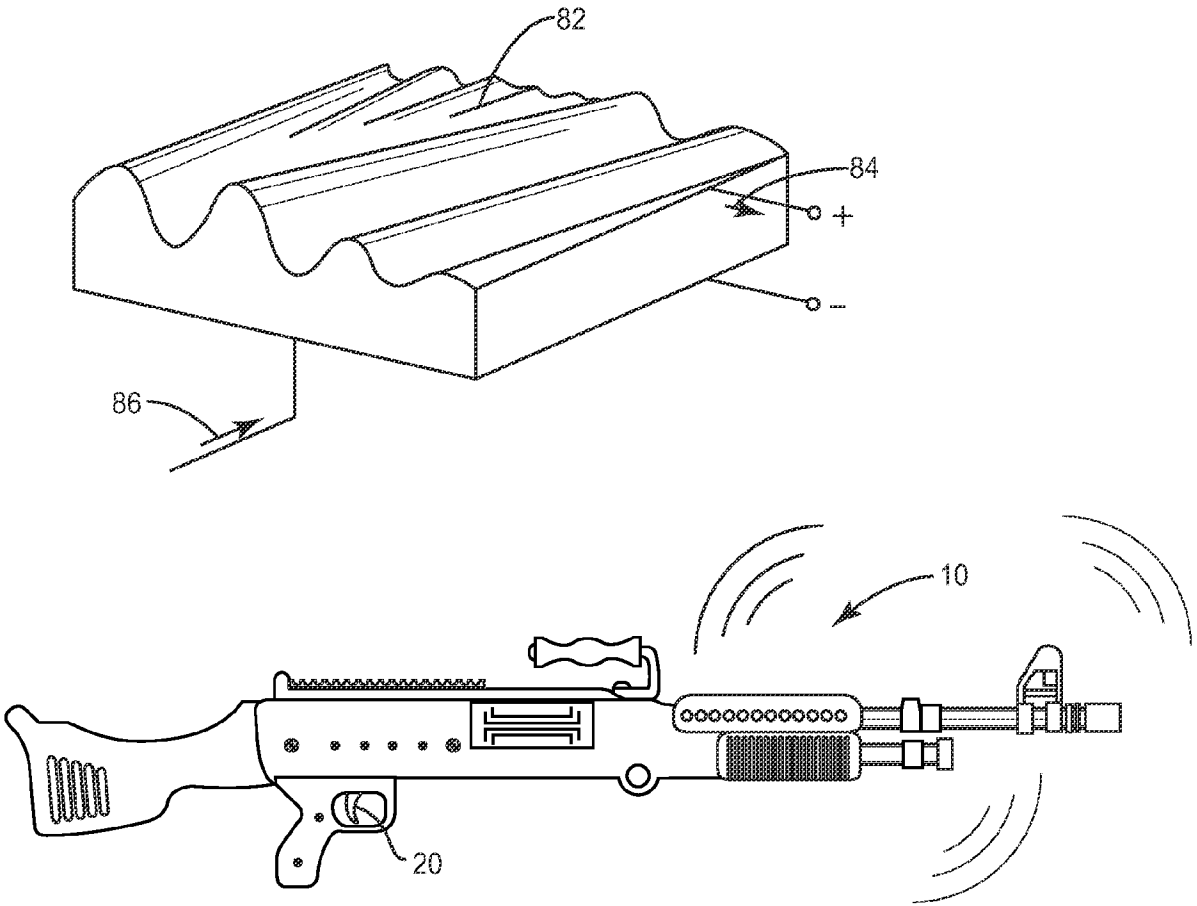
FIG. 7 illustrates one embodiment of sequences of real-time electronic responses resulting from sequences of real-time electronic vibrations.

Referring now to FIGS. 4 and 7, FIG. 7 illustrates one embodiment of the sensing apparatus 66 shown in FIG. 4, which in this example is a single piezoelectric sensor 82. The piezoelectric sensor 82 is operable to sense the sequence of real-time mechanical vibrations on the firearm by generating sequences of real-time electronic responses 84 that correspond to the sequences of real-time mechanical vibrations on the firearm. The real-time mechanical vibrations cause displacements in the piezoelectric sensor 82 and the piezoelectric sensor 82 generates real-time electronic responses 84 as a result of the real-time mechanical vibrations. In this embodiment, the piezoelectric sensor 82 may receive a sensitivity signal 86 that sets an adjustable minimum vibrational level that can be sensed by the piezoelectric sensor 82. The sensitivity signal 86 can be utilized to set the minimum vibrational level required to generate real-time electronic responses 84 from the piezoelectric sensor 82. Thus, the real-time mechanical vibrations need to have a vibrational level at least as high as the minimum vibrational level for the piezoelectric sensor 82 to generate the real-time electronic responses 84.

Figure 8:
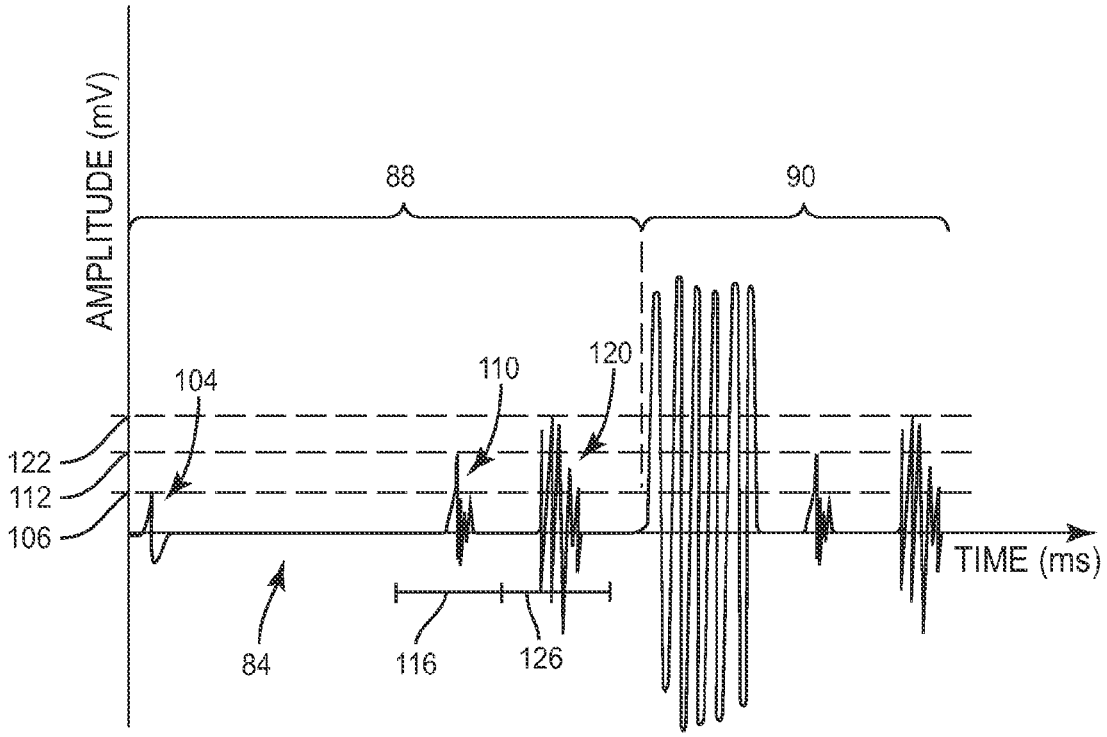
FIG. 8 illustrates one embodiment of a sensing apparatus for the laser transmission system shown in FIG. 4.

FIG. 8 illustrates one embodiment of real-time electronic responses 84 generated by the piezoelectric sensor 82 shown in FIG. 7. The real-time electronic responses 84 include a first sequence 88 associated with the real-time mechanical vibrations resulting from the firing of an initial munition from the M240 machine gun and a second sequence 90 of real-time electronic responses 84. The first sequence 88 of real-time electronic responses 84 results from an initial munition firing cycle that includes a trigger pull action. The second sequence 90 of real-time electronic responses 84 results from the flash event associated with the firing of the initial munition and pre-flash firing events associated with the firing of a subsequent munition after the initial munition firing cycle but prior to the trigger return action that stops automatic fire. The munitions may be blank munitions fired from the M240 machine gun during a battle field training exercise.

Figure 9:
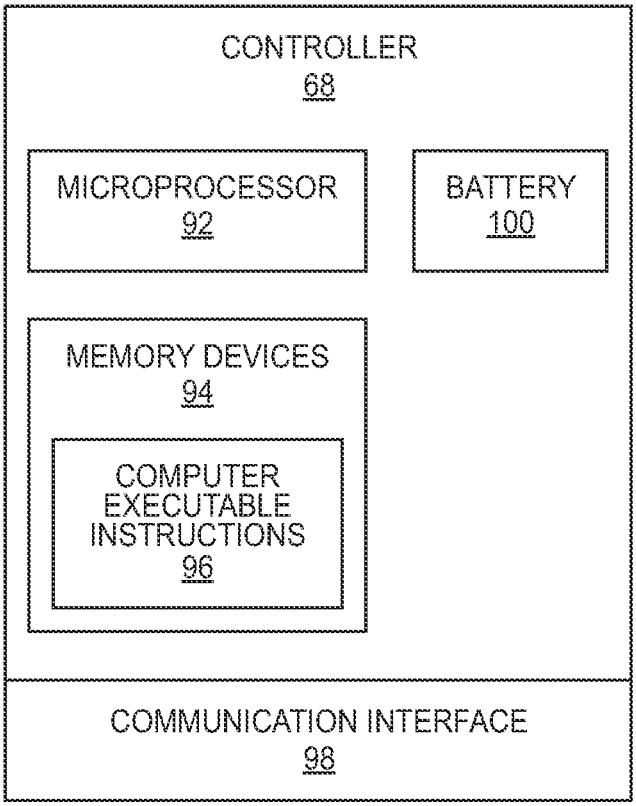
FIG. 9 illustrates one embodiment of a controller shown in FIG. 4.

Referring now to FIGS. 4 and 9, FIG. 9 illustrates a block diagram of one embodiment of the controller 68 in the laser transmission system 12 shown in FIG. 4. The controller 68 includes at least one microprocessor 92 and one or more memory devices 94 that store computer executable instructions 96. The microprocessor 92 executes the computer executable instructions 96 to provide a software module. Note that the software module may be either mutually exclusive of other software modules implemented by the microprocessor 92 or may be integrated or partially integrated within other software modules. In this embodiment, the controller 68 is implemented using general purpose processing hardware, such as the microprocessor 92, so that the controller 68 provides the desired control functions. Alternatively, the controller 68 may be implemented using hardware components, such as a hardwired circuit analog that provides the same functionality as the software module or through a combination hardwired components and software modules. The microprocessor 92 and memory devices 94 may be communicatively associated with a communication interface 98 that allows the controller 68 to receive and transmit signals to the laser transmitter 64 and the piezoelectric sensor 82 (shown in FIG. 7), and, if necessary, to other components external to the laser transmission system 12. The communication interface 98 may include one or more communication devices and/or translation hardware operable to format signals in accordance with the requirements of the microprocessor 92 and output signals in accordance with the requirements of the laser transmitter 64, piezoelectric sensor 82, and/or other components external to the laser transmission system 12. To provide power to operate the microprocessor 92, the memory devices 94, and the communication interface 98, the controller 68 may include a battery 100.

Figure 10:
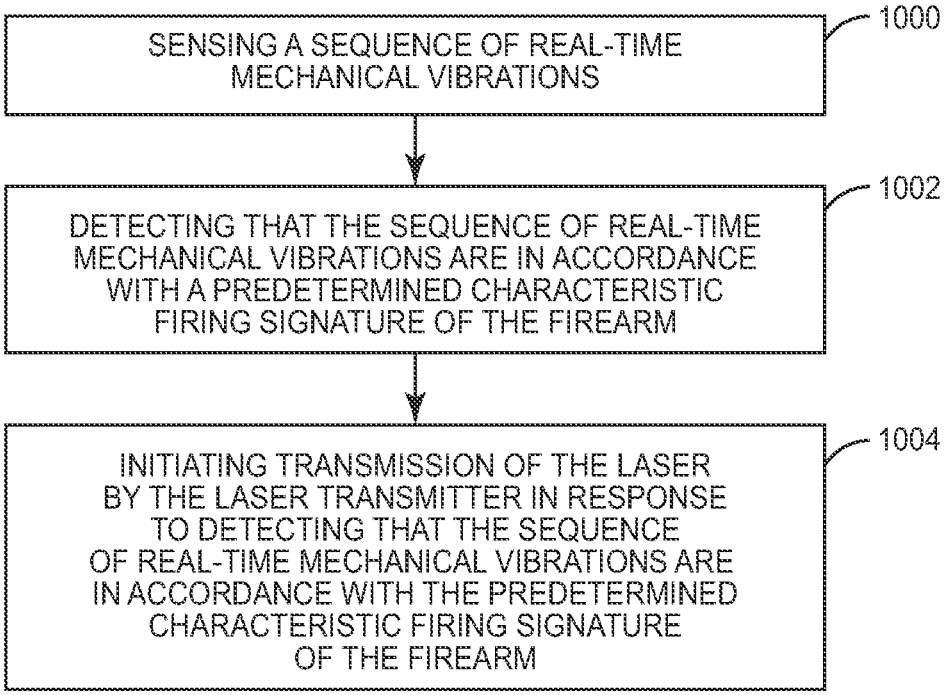
FIG. 10 illustrates exemplary procedures implemented by the laser transmission system of FIG. 4 to initiate transmission of a laser.

Referring now to FIGS. 4 and 10, FIG. 10 illustrates one embodiment of exemplary procedures which are implemented by the laser transmission system 12 shown in FIG. 4 to initiate transmission of the laser 26. The exemplary procedures may be implemented by the laser transmission system 12 during a battle field training exercise so that the laser 26 can simulate real-time munition strikes from the M240 machine gun. However, other embodiments of the exemplary procedures may be implemented to simulate real-time munition strikes from any firearm.

To initiate transmission of the laser 26, the piezoelectric sensor 82 (shown in FIG. 7) senses a sequence of real-time mechanical vibrations of the firearm (procedure 1000). The controller 68 determines whether the sequence of real-time mechanical vibrations are the result of the first pre-flash firing event and the second pre-flash firing event by detecting that the sequence of real-time mechanical vibrations are in accordance with the predetermined characteristic firing signature 72 (shown in FIG. 6) of the firearm (procedure 1002). The controller 68 initiates transmission of the laser 26 by the laser transmitter 64 in response to detecting that the sequence of real-time mechanical vibrations are in accordance with the predetermined characteristic firing signature 72 of the firearm 10 (procedure 1004).

Referring again to FIGS. 4 and 8, the piezoelectric sensor 82 in FIG. 7 may sense a sequence of real-time mechanical vibrations in accordance with exemplary procedure 1000 of FIG. 10. In this example, the piezoelectric sensor 82 senses a first sequence of real-time mechanical vibrations by generating the first sequence 88 of real-time electronic responses 84 in FIG. 8. The first sequence 88 of real-time electronic responses 84 correspond to the sequence of real-time mechanical vibrations resulting from the firing of the initial munition from the M240 machine gun. The controller 68 may receive the first sequence 88 of real-time electronic responses 84 from the piezoelectric sensor 82.

Referring again to FIGS. 6 and 9, the controller 68 (shown in FIG. 9) is operable to detect whether the sequence of real-time mechanical vibrations are in accordance with the predetermined characteristic firing signature 72 in accordance with exemplary procedure 1002 of FIG. 10. In one embodiment, the microprocessor 97 may be a digital signal processor that is configured by the computer executable instructions 96 to compare the first sequence 88 of real-time electronic responses 84 to the predetermined characteristic firing signature 72. However, this computation may take up a significant amount of power from the battery 100. Also, signature calculations may require storing a version of the predetermined characteristic firing signature 72 and may be rather sophisticated.

Referring again to FIGS. 6 and 8, software implemented by the controller 68 (shown in FIG. 9) configures the controller 68 to detect when a first one 104 (shown in FIG. 8) in the first sequence 88 of the real-time electronic responses 84 is at least as high as a first minimum amplitude level 106. For example, the first minimum amplitude level 106 may be or may be related to an amplitude level 108 (shown in FIG. 6) of the first set 74 of predetermined electronic responses 73 in the predetermined characteristic firing signature 72. In this manner, the controller 68 detects that the first sequence 88 of real-time electronic responses 84 have been provided in accordance with the first set 74 of predetermined electronic responses 73. As mentioned above, the first set 74 of predetermined electronic responses 73 is the characteristic firing event signature of the trigger pull action. In response to detecting the first one 104 of the first sequence 88 of real-time electronic responses 84, the controller 68 is configured to detect when a second one 110 (shown in FIG. 8) of the first sequence 88 of the real-time electronic responses 84 is at least as high as a second minimum amplitude level 112. For example, the second minimum amplitude level 112 may be or be related to an amplitude level 114 (shown in FIG. 6) of the second set 76 of predetermined electronic responses 73 in the predetermined characteristic firing signature 72. In this manner, the controller 68 detects that the first sequence 88 of real-time electronic responses 84 have been provided in accordance with the second set 76 of predetermined electronic responses 73. As mentioned above, the second set 76 of predetermined electronic responses 73 is the characteristic firing event signature of the chambering action. The controller 68 may also detect that the second one 110 of the real-time electronic responses 84 occurs within a time period 116 (shown in FIG. 8) after the first one 104 of the real-time electronic responses 84. The time period 116 may be based on a temporal distance 118 (shown in FIG. 6) between the first set 74 of predetermined electronic responses 73 and the second set 76 of predetermined electronic responses 73 in the predetermined characteristic firing signature 72.

By detecting that the first one 104 and the second one 110 of the first sequence 88 are in accordance with the first set 74 and second set 76 of predetermined electronic responses 73 in the predetermined characteristic firing signature 72, the controller 68 is ensured that the first sequence 88 of the real-time electronic responses 84 are the result of the first pre-flash firing event and the second subsequent pre-flash firing event, in this case the trigger pull action and the chambering action, rather than some unrelated action. This embodiment of the controller 68 may thus detect that the sequence of real-time mechanical vibrations are in accordance with the predetermined characteristic firing signature 72 without requiring complex signature calculations or storage of a version of the predetermined characteristic firing signature 72. The controller 68 also requires less power from the battery 100 to allow for longer battle field training exercises.

In still another embodiment, in response to detecting the first one 104 (shown in FIG. 8) from the first sequence 88 of real-time electronic responses 84, the controller 68 is configured to detect when a third one 120 from the first sequence 88 of real-time electronic responses 84 is at least as high as a third minimum amplitude level 122, rather than or in addition to the second one 110 (shown in FIG. 8) of the real-time electronic responses 84. The third minimum amplitude level 122 may be or be related to an amplitude level 124 (shown in FIG. 6) of the third set 78 of predetermined electronic responses 73 in the predetermined characteristic firing signature 72. In this manner, the controller 68 detects that the first sequence 88 of real-time electronic responses 84 have been provided in accordance with the third set 78 of predetermined electronic responses 73. As discussed above, the third set 78 of predetermined electronic responses 73 is the characteristic firing event signature of the munition discharge action. The controller 68 may also detect that the third one 120 of the real-time electronic responses 84 occurs within a time period 126 (shown in FIG. 8) after the first one 104 in the first sequence 88 of the real-time electronic responses 84. The time period 126 may be based on a temporal distance 127 (shown in FIG. 6) between the first set 74 and the third set 78 of predetermined electronic responses 73.

Note that the amplitude level 108 in FIG. 6 is lower than both the amplitude level 114 and the amplitude level 124 in FIG. 6. The amplitude level 108 is associated with a first vibrational level because predetermined mechanical vibrations at the first vibrational level were required to generate the electronic responses at the amplitude level 108. Similarly the amplitude level 114 and the amplitude level 124 are each associated with a second vibrational level and a third vibrational level, respectively, because predetermined mechanical vibrations at the second vibrational level and the third vibrational level were required to generate the second set 76 and the third set 78 of predetermined electronic responses 73 at the amplitude levels 114, 124. Consequently, the first set 74, the second set 76, and the third set 78 of predetermined electronic responses 73 are each associated with the first vibrational level, the second vibrational level, and the third vibrational level. Again, the first set 74, the second set 76, and the third set 78 are the characteristic firing event signatures of the trigger pull action, the chambering action, and the munition discharge action.

Referring again to FIGS. 6-8, in one embodiment, the first minimum amplitude level 106 (shown in FIG. 8) is essentially the same as the amplitude level 108 (shown in FIG. 6), the second minimum amplitude level 112 (shown in FIG. 8) is essentially the same as the amplitude level 114 (shown in FIG. 6), and the third minimum amplitude level 122 (shown in FIG. 8) is essentially the same as the amplitude level 124 (shown in FIG. 6). To detect that the first one 104 (shown in FIG. 8) of the first sequence 88 in the real-time electronic responses 84 is in accordance with the first set 74 (shown in FIG. 6) of predetermined electronic responses 73, the controller 68 may be configured to adjust the sensitivity signal 86 (shown in FIG. 7) so that the minimum vibrational level is at the first vibrational level associated with the amplitude level 108 (shown in FIG. 6). Since the first one 104 in the first sequence 88 of the real-time electronic responses 84 is at least as high as the first minimum amplitude level 106 (shown in FIG. 8), the first one 104 in the first sequence 88 of real-time electronic responses 84 has been caused by a real-time mechanical vibration at least as high as the first vibrational level.

In response to detecting the first one 104 in the first sequence 88 of the real-time electronic responses 84, the controller 68 adjusts the sensitivity signal 86 (shown in FIG. 7) to the second vibrational level associated with the amplitude level 114 (shown in FIG. 6) or the third vibrational level associated with the amplitude level 114 (shown in FIG. 6). To detect that the second one 110 (shown in FIG. 8) of the first sequence 88 in the real-time electronic responses 84 is in accordance with the second set 76 (shown in FIG. 6) of predetermined electronic responses 73, the controller 68 adjusts the sensitivity signal 86 (shown in FIG. 7) so that the minimum vibrational level is at the second vibrational level associated with the amplitude level 114 (shown in FIG. 6). To detect that the third one 104 (shown in FIG. 8) of the first sequence 88 in the real-time electronic responses 84 is in accordance with the third set 78 (shown in FIG. 6) of predetermined electronic responses 73, the controller 68 adjusts the sensitivity signal 86 (shown in FIG. 7) so that the minimum vibrational level is at the third vibrational level associated with the amplitude level 124 (shown in FIG. 6).

In another embodiment, rather than providing a single piezoelectric sensor 82, the sensing apparatus 66 may include more than one piezoelectric sensor 82 each set to different minimum vibrational levels. The controller 68 detects each of the first one 104 (shown in FIG. 8) and the second one 110 (shown in FIG. 8) and the third one 120 (shown in FIG. 8) in the first sequence 88 of real-time electronic responses 84 from different piezoelectric sensors in the sensing apparatus 66 (shown in FIG. 4).

Referring again to FIGS. 4 and 9, the controller 68 illustrated in FIG. 9 initiates transmission of the laser 26 in accordance with the exemplary procedure 1004 shown in FIG. 10. In this embodiment, the controller 68 has been configured to generate and send the laser initiation signal 71 in response to the controller 68 detecting that the sequence of real-time mechanical vibrations are in accordance with the predetermined characteristic firing signature 72 (shown in FIG. 6).

Figure 11:
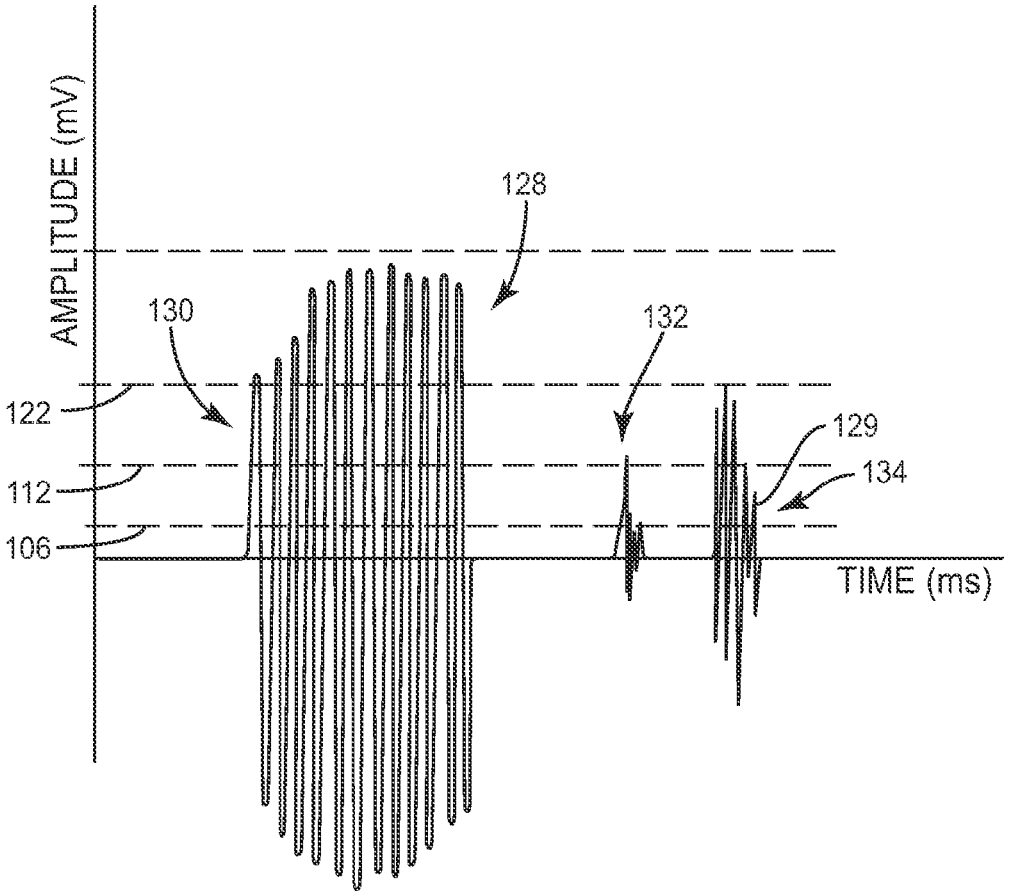
FIG. 11 illustrates one embodiment of a second predetermined characteristic firing signature.

Referring now to FIGS. 4 and 11, FIG. 11 illustrates one embodiment of a second predetermined characteristic firing signature 128. The second predetermined characteristic firing signature 128 may be utilized to again initiate transmission of the laser 26 when a subsequent munition is fired from the M240 machine gun after detecting that the initial munition has been fired from the M240 machine gun but prior to the trigger release action. As discussed above the munition firing cycle associated with the firing of the initial munition includes a trigger pull action. However, the M240 machine gun provides automatic fire and, as mentioned above, if the trigger remains depressed, munition firing cycles after the initial munition firing cycle do not include the trigger pull action. Generally, for medium and heavy machine guns like the M240 machine gun, the initial munition fired may be the most accurate munition strike since it becomes difficult to aim the M240 machine gun due to the movement resulting from the flash event. Nevertheless, the second predetermined characteristic firing signature 128 may be utilized to detect the firing of subsequent munitions during automatic fire to more accurately simulate munitions strikes in accordance with subsequent munition firing cycles that do not include the trigger pull action.

The second predetermined characteristic firing signature 128 shown in FIG. 11 has also been generated by piezoelectric sensors as a sequence of predetermined electronic responses 129. The second predetermined characteristic firing signature 128 is based on a sequence of predetermined mechanical vibrations that result from the flash event associated with the firing of the initial munition, and pre-flash firing events that occur prior to a flash event associated with the firing of a subsequent munition. A first set 130 of predetermined electronic responses 129 corresponds to predetermined mechanical vibrations from the flash event of the initial munition. A second set 132 of the predetermined electronic responses 129 correspond to the predetermined mechanical vibrations from a chambering action associated with firing the subsequent munition. The third set 134 of predetermined electronic responses in the second predetermined characteristic firing signature 128 corresponds to predetermined mechanical vibrations from a munition discharge action associated with firing the subsequent munition.

Referring now to FIGS. 4, 6, 8 and 11, during a battle field training exercise, the controller 68 may be configured to detect that the real-time mechanical vibrations on the firearm are provided in accordance with second predetermined characteristic firing signature 128 after detecting that the first sequence 88 of real-time electronic responses 84 have been provided in accordance to the predetermined characteristic firing signature 72 in FIG. 6. In this embodiment, the controller 68 receives the second sequence 90 of real-time electronic responses from the piezoelectric sensor 82 and detects that the second sequence 90 of real-time electronic responses 84 are in accordance with both the first set 130 of predetermined electronic responses 129 and the second set 132 of predetermined electronic responses 129 in the second predetermined characteristic firing signature 128. Alternatively, the controller 68 receives the second sequence 90 of real-time electronic responses from the piezoelectric sensor 82 and detects that the second sequence 90 of real-time electronic responses 84 are in accordance with both the first set 130 of predetermined electronic responses 129 and the third set 134 of predetermined electronic responses 129 in the second predetermined characteristic firing signature 128. In this manner, the controller 68 may detect that the real-time mechanical vibrations are provided in accordance with a flash event associated with the firing of a previously fired munition, such as the flash event of the initial munition, and with a pre-flash firing event, such as the chambering action or the munition discharge action that occur prior to the flash event of the subsequent munition fired by the firearm. In yet another alternative embodiment, all three sets of electronic responses may be utilized to detect that the sequence of real-time mechanical vibrations are in accordance with the second predetermined characteristic firing signature 128. Each time the controller 68 detects that a sequence of real-time mechanical vibrations are in accordance with the second predetermined characteristic firing signature 128, the controller 68 again initiates transmission of the laser 26 to simulate another munitions strike from the M240 machine gun.

Embodiments of the laser transmission system 12 may be used in military combat training system to simulate munitions strikes from any firearm being utilized in a battle field training exercise. One such military combat training system is MILES. MILES is a military combat training system that has been developed to allow for a wide range of military equipment and weapons to be utilized in battle field training exercises. MILES is flexible in that a wide variety of military equipment and weapons may be utilized during battle field training exercises. Thus, MILES allows for battle field training exercises to be designed specifically to train infantry using just firearms. On the other hand, MILES also allows for the simulation of large scale battle operations including a wide variety of military equipment and weapons, such as firearm, tanks, artillery, missiles, biological weapons, chemical weapons, and even nuclear weapons. Weapons strikes are simulated through the use of the laser 26. Military personnel, vehicles, and/or equipment are provided with laser receiver systems. These laser receiver systems may be illuminated by the laser 26 to determine "kills" from the weapons strikes. Later versions of MILES record "kills" and location information at centralized computer systems. These centralized computer systems help determine the performance of military equipment and personnel by allowing the data generated during a battle field training exercise to be gathered and stored for analysis.

To enable the use of such a wide variety of military equipment and military weapons, MILES provides standards for the transmission of data. Embodiments of the laser transmission system 12 may be configured in accordance with the data transmission standards provided by MILES. In this manner, the laser transmission system 12 may be mounted on firearm so that the firearm can be used in MILES battle field training exercises. In a current implementation of MILES, for each munition fired by the firearm, MILES defines a full set of messages for a munition strike as four (4) kill messages followed by one hundred twenty (120) near-miss messages. The laser transmitter 64 may thus be configured to transmit the laser 26 such that the laser 26 includes kill messages and near-miss messages formatted in accordance with MILES. The kill messages and near-miss messages each take approximately 3.7 milliseconds (ms) in the current implementation of MILES and at least two (2) kill messages need to be recorded by the laser receiver system to record a "kill." Thus, a full set of messages requires around 455 ms.

Referring again to FIGS. 4, 6 and 11, FIG. 6 indicates that, for the M240 machine gun, the temporal distance 118 (shown in FIG. 6) between the chambering action and the trigger pull action is approximately 25 ms, while the temporal distance 127 (shown in FIG. 6) between the munition discharge action and the trigger pull action is approximately 45 ms. A temporal distance 136 (shown in FIG. 6) between the flash event and the trigger pull action is approximately 60 ms. As discussed above, to detect that the sequence of real-time mechanical vibrations are in accordance with the predetermined characteristic firing signature 72 of the firearm, the predetermined characteristic firing signature 72 may be based on the predetermined mechanical vibrations caused by the trigger pull action and the chambering action, the trigger pull action and the munition discharge action, or all three pre-flash firing actions. In each case, the last pre-flash firing event occurs sufficiently prior to the flash event of the M240 machine gun such that transmission of the laser 26 is initiated with sufficient time for the laser transmitter 64 to transmit more than two kill messages in the laser 26 before the flash event. If the last pre-flash firing event is the chambering action, there are still approximately 35 ms until the flash event and thus all four kill messages may be transmitted before the flash event. On the other hand, if the last pre-flash firing event is the munition discharge action there are still 15 ms until the flash event and thus three kill messages can be transmitted prior to the flash event. This is sufficient time for enough kill messages to be transmitted by the laser 26 prior to the changes in orientation caused by the flash event so that a "kill" can be recorded by a laser receiver system illuminated by the laser 26. The laser transmission system 12 (shown in FIG. 4) can thus more accurately simulate munitions strikes from the firearm based on the aim provided by the gun operator.

Note that the M240 machine gun is an automatic firearm that has munition firing cycles that are significantly faster than 455 ms. The same is true for other types of automatic machine guns. As a result, during automatic fire the full set of the transmission of four (4) kill messages and one hundred twenty (120) near-miss messages may not be transmitted. Rather, sometime at midstream, the laser transmission system 12 picks up the real-time mechanical vibrations on the firearm associated with the firing of a subsequent munition based on the second predetermined characteristic firing signature 128 in FIG. 11. The laser transmission system 12 stops transmitting the set of messages for the initial munition to prevent any inappropriate correlation of messaging between munition strikes. The laser transmission system 12 then again initiates transmission of the laser 26 beginning with a new set of messages. Upon detecting that the real-time mechanical vibrations indicate that yet another subsequent munition has been fired during automatic fire based on the second predetermined characteristic firing signature 128 in FIG. 11, the laser transmission system 12 stops transmitting the set of messages for the previously fired subsequent munition and again initiates transmission of the laser 26 beginning with a new set of messages. While the laser transmission system 12 may not transmit the full set of messages for each munition strike, sufficient kill messages are transmitted prior to the flash events of each fired munition to accurately approximate a munition strike from the firearm.

Figure 12:
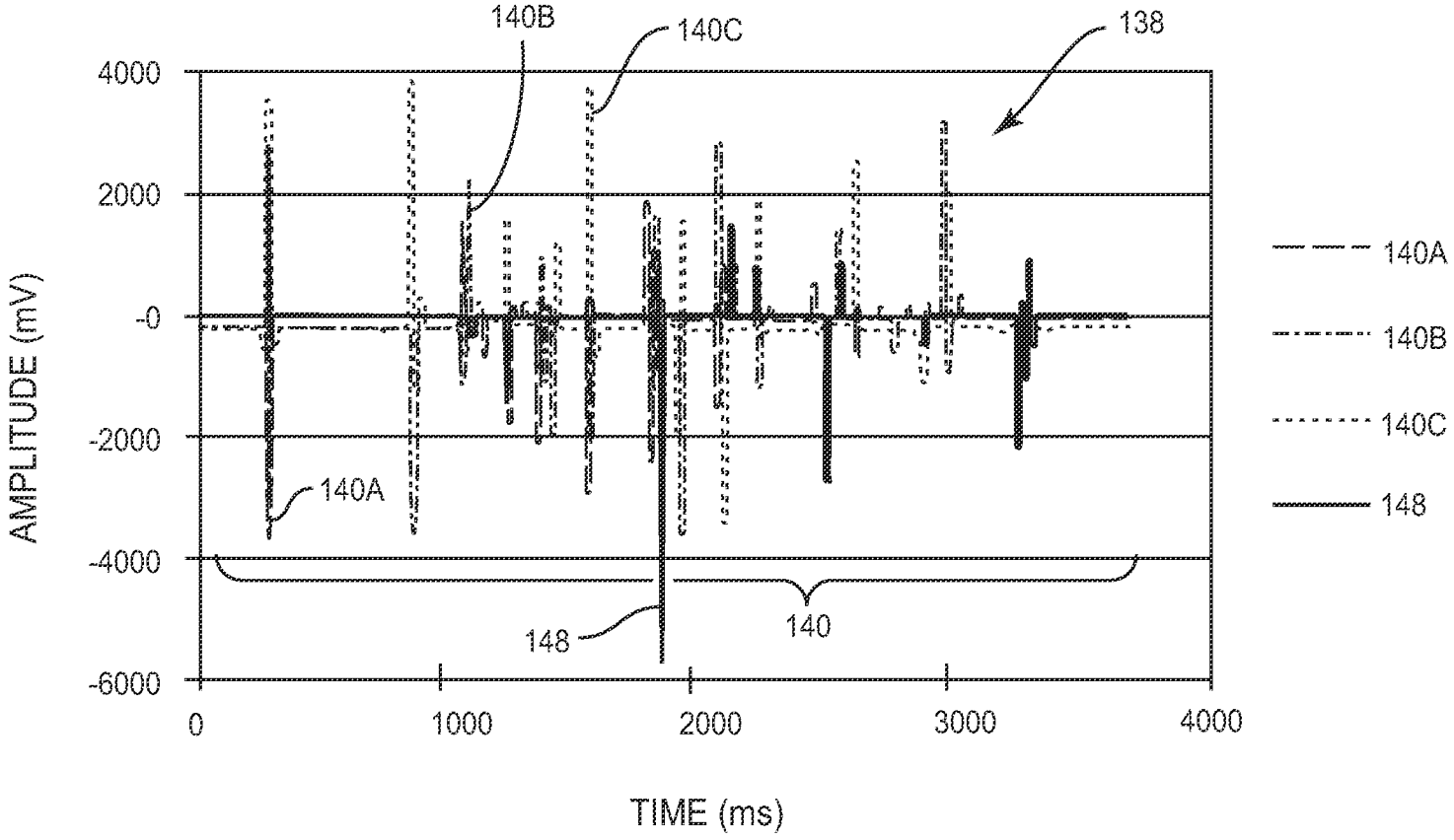
FIG. 12 illustrates another embodiment of a predetermined characteristic firing signature for the M240 machine gun shown in FIG. 1.

Next, FIG. 12 illustrates another embodiment of a predetermined characteristic firing signature 138 for the M240 machine gun. The predetermined characteristic firing signature 138 is based on the sequence of predetermined mechanical vibrations resulting from a first pre-flash firing event and a subsequent second pre-flash firing event, which are each associated with the firing of a munition. The predetermined characteristic firing signature 138 in FIG. 12 was predetermined utilizing one or more accelerometers in association with the firing of a blank munition from the M240 machine gun. However, accelerometers may be utilized to predetermine the predetermined characteristic firing signature 138 of any firearm regardless of the type of munition being fired. The accelerometers generate the predetermined characteristic firing signature 138 as a sequence of predetermined electronic responses 140. The sequence of predetermined electronic responses 140 include predetermined electronic responses 140A, 140B, and 140C. Each of the predetermined electronic responses 140A, 140B, and 140C is based on predetermined accelerations resulting from a sequence of predetermined mechanical vibrations along one of three orthogonal directions. In this particular example, the sequence of predetermined electronic responses 140 corresponds to the sequence of accelerations resulting from three pre-flash firing actions. The first pre-flash firing event is the trigger pull action while the subsequent second pre-flash firing event is a combination of the munition stripping action and the chambering action. The subsequent second pre-flash firing event thus corresponds to the set of pre-flash firing actions in which the munition is removed from the belt and placed in the chamber by the bolt.

In this example, the sequence of predetermined accelerations are measured along a Z-axis directed vertically from the firearm, a X-axis substantially perpendicular to the Z-axis and being substantially parallel to the barrel, a Y-axis substantially perpendicular to the Z-axis and the X-axis. However, while this configuration of the Z-axis, X-axis, and Y-axis is convenient, the direction of the Z-axis, X-axis, and Y-axis relative to the firearm may be arbitrarily selected. Another configuration of the Z-axis, X-axis, and Y-axis generates a different sequence of electronic responses along the Z-axis, X-axis, and Y-axis. Nevertheless, the predetermined mechanical vibrations are the same and the predetermined accelerations associated with the predetermined mechanical vibrations are different simply because the directional components of the accelerations are being measured along a different configuration of the Z-axis, X-axis, and Y-axis.

Figure 13:
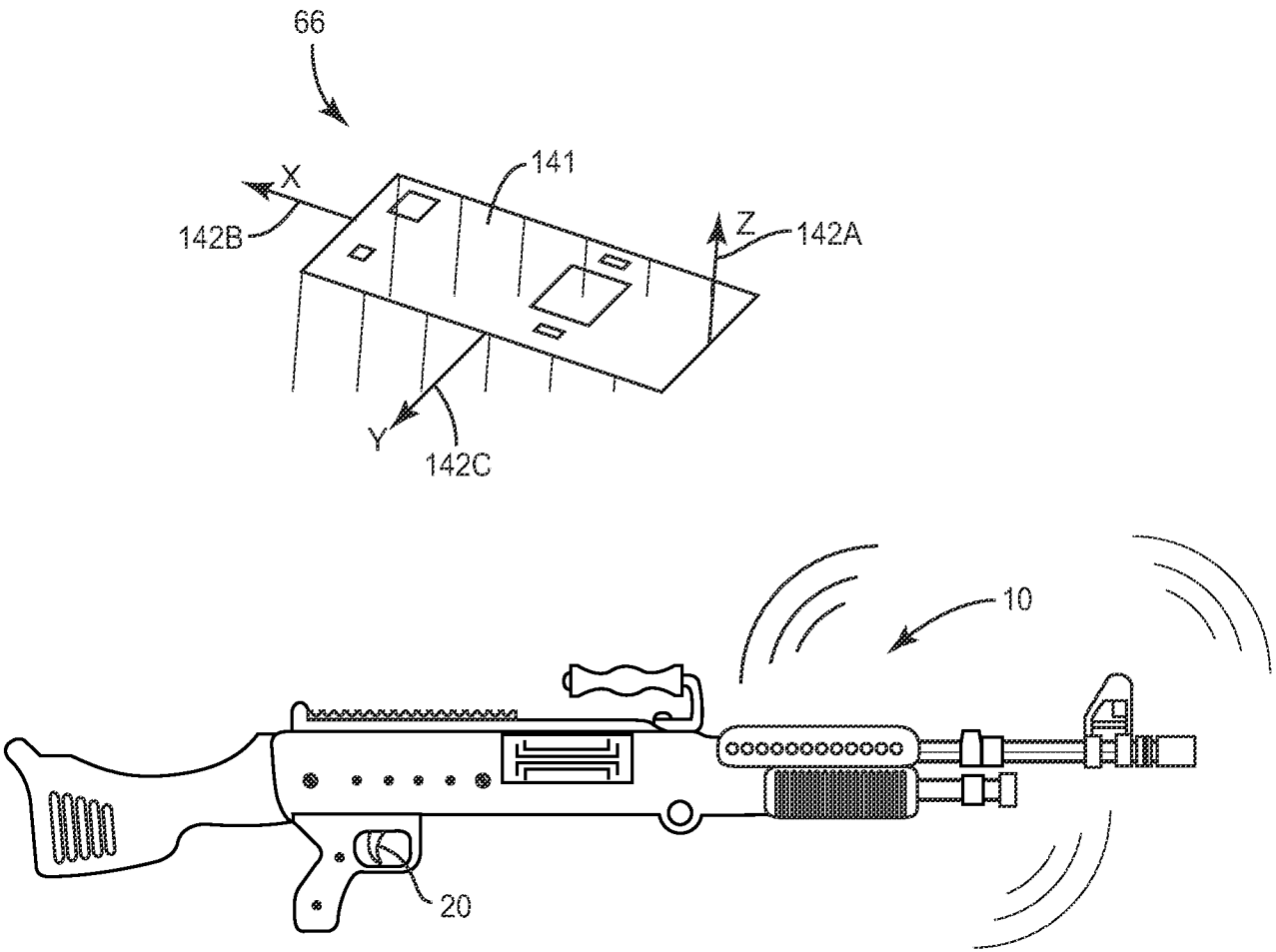
FIG. 13 illustrates another embodiment of the sensing apparatus of the laser transmission system shown in FIG. 4.

FIG. 13 illustrates another embodiment of the sensing apparatus 66 in FIG. 4. In this example, the sensing apparatus 66 is an accelerometer 141. The accelerometer 141 generates a sequence of real-time electronic responses 144. The sequence of real-time electronic responses 144 correspond to a sequence of real-time accelerations resulting from a sequence of real-time mechanical vibrations along three orthogonal directions. The accelerometer 141 may be provided in the laser transmission system 12 so that the Z-axis 142A, X-axis 142B, and Y-axis 142C of the accelerometer 141 are configured in the same manner as the configuration of the Z-axis, X-axis, and Y-axis used to predetermine the predetermined characteristic firing signature 138. In alternate embodiments, the controller 68 may be configured to perform coordinate system transformations upon receiving the sequence of real-time electronic responses 144. Also while a single accelerometer 141 illustrated in FIG. 13 is used as the sensing apparatus 66 (shown in FIG. 4), alternate embodiments may utilize multiple accelerometers. For example, the sensing apparatus 66 may include three accelerometers, each measuring the accelerations along one axis 142A, 142B, and 142C.

Figure 14:
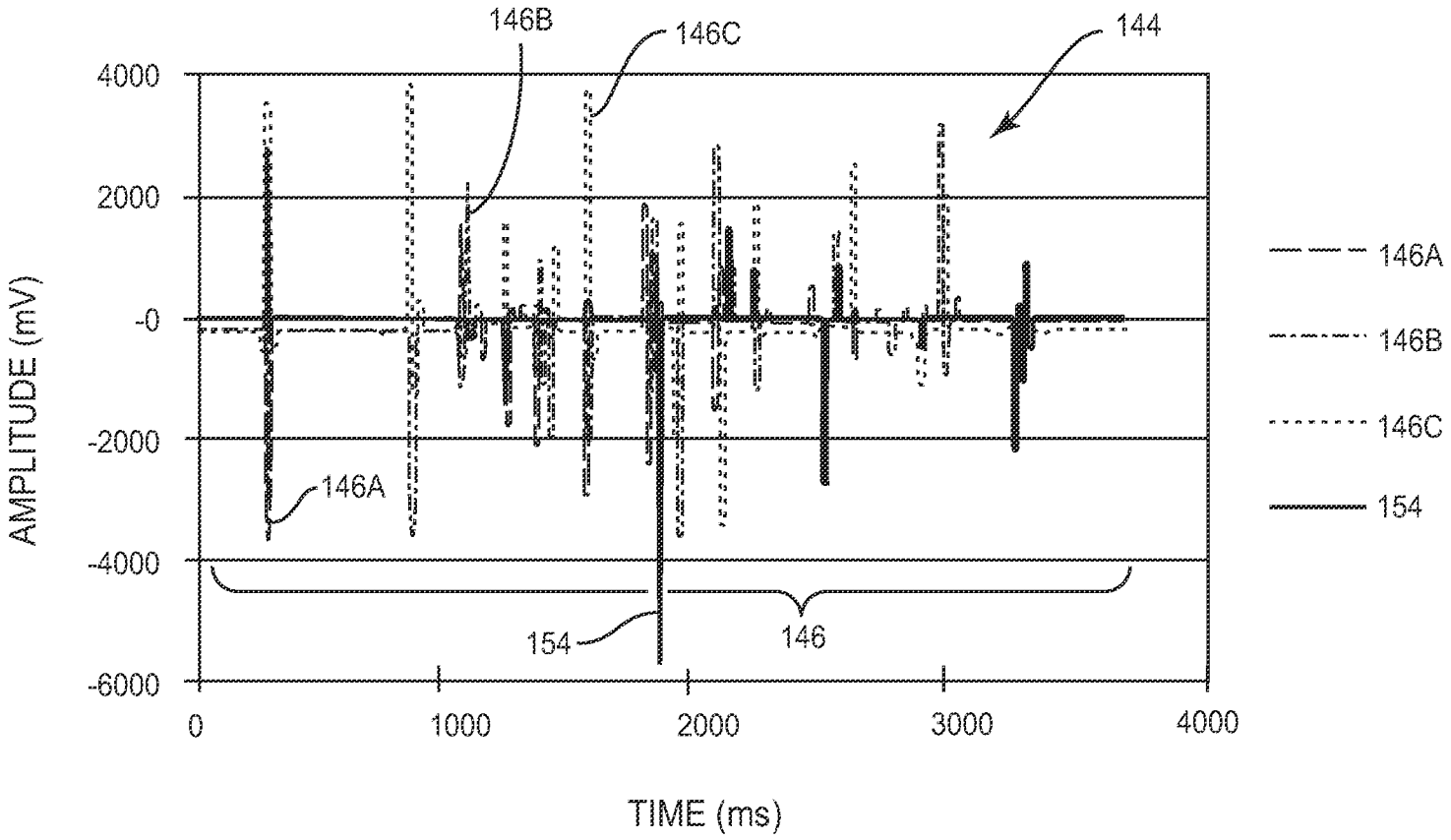
FIG. 14 illustrates another embodiment of sequences of real-time electronic responses resulting from sequences of real-time electronic vibrations.

FIG. 14 illustrates one embodiment of the sequence of real-time electronic responses 144. The sequence of real-time electronic responses 144 have been generated by the accelerometer 141 during a battle field training exercise. The sequence of real-time electronic responses 144 include electronic responses 146A, 146B, 146C resulting from accelerations due to a sequence of real-time mechanical vibrations along the Z-axis 142A, X-axis 142B, and Y-axis 142C. The sequence of real-time electronic responses 144 of FIG. 14 result from of a munition, in this case a blank munition, being fired during a battle field training exercise.

Figure 15:
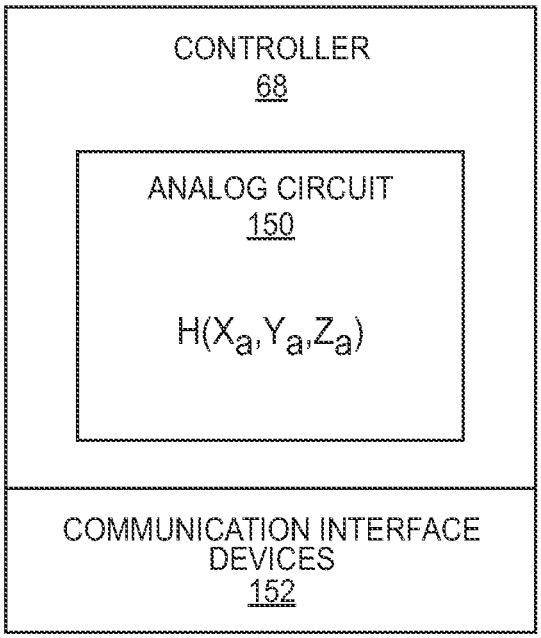
FIG. 15 illustrates another embodiment of the controller shown in FIG. 4.

FIG. 15 illustrates another embodiment of the controller 68 shown in FIG. 4. The controller 68 is configured to receive the sequence of real-time electronic responses 144 (shown in FIG. 14) and detect whether the sequence of real-time electronic responses 144 are in accordance with the predetermined characteristic firing signature 138 (shown in FIG. 12). The controller 68 in FIG. 15 has been predesigned based on a transfer function H ($x_a$, $y_a$, $z_a$). The transfer function H ($x_a$, $y_a$, $z_a$) is operable to detect whether the sequence of real-time electronic responses 144 (shown in FIG. 14) are provided in accordance with the predetermined characteristic firing signature 138 (shown in FIG. 12). A first noise extraction calculation 148 (shown in FIG. 12) may be performed on the sequence of predetermined electronic responses 140 to predesign the transfer function H ($x_a$, $y_a$, $z_a$). The transfer function H ($x_a$, $y_a$, $z_a$) inputs the sequence of real-time electronic responses 144 (shown in FIG. 14), including the real-time electronic responses 144A, 144B, 144C resulting from real-time accelerations along the Z-axis 142A, X-axis 142B, and Y-axis 142C due to real-time mechanical vibrations. If the sequence of real-time electronic responses 144 (shown in FIG. 14) indicates that there are real-time mechanical vibrations similar to the predetermined mechanical vibrations represented by the first noise extraction calculation 148 (shown in FIG. 12), the result of the transfer function ($x_a$, $y_a$, $z_a$) generates an output designed to initiate transmission of the laser 26. The transfer function H ($x_a$, $Y_a$, $z_a$) may be modeled through mathematical computer techniques and the like. An analog circuit 150 is then designed in accordance with the transfer function H ($x_a$, $y_a$, $z_a$) and included in the controller 68.

In the embodiment of an analog circuit 150 of FIG. 15, the controller 68 includes a communication interface 152 so that the analog circuit 150 may receive the sequence of real-time electronic responses 144 (shown in FIG. 14). One exemplary embodiment of the transfer function H ($x_a$, $y_a$, $z_a$) may perform a second noise extraction calculation 154 (shown in FIG. 14) utilizing the sequence of real-time electronic responses 144 (shown in FIG. 14) so that the analog circuit 150 generates a laser initiation signal 71 when the second noise extraction calculation 154 (shown in FIG. 14) is within a parameter range of the first noise extraction calculation 148 (shown in FIG. 12). The first noise extraction calculation 148 (shown in FIG. 12) and the second noise extraction calculation 154 (shown in FIG. 14) may each be sum over the difference calculations. However, any suitable noise extraction calculation may be utilized, if desired. The controller 68 is coupled by the communication interface 152 to the laser transmitter 64 (shown in FIG. 4). The laser transmitter 64 sends the laser initiation signal 71 (shown in FIG. 4) to initiate transmission of the laser 26 (shown in FIG. 4). The analog circuit 150 thus allows the controller 68 to detect that sequences of real-time mechanical vibrations sensed by the accelerometer 141 are in accordance with the predetermined characteristic firing signature 138 (shown in FIG. 12). In this manner, the controller 68 can initiate transmission of the laser 26 so that the laser 26 simulates a munition strike from the firearm during battle field training exercises. However, since the predetermined characteristic firing signature 138 (shown in FIG. 12) is based on the mechanical vibrations of the first pre-flash firing event and the subsequent second pre-flash firing event, it becomes very difficult for a gun operator to cause artificial vibrations having a noise extraction calculation within the parameter range.

As discussed above, the sequence of real-time electronic responses 144 (shown in FIG. 14) result from of a munition, in this case a blank munition, being fired during a battle field training exercise. Since the second noise extraction calculation 154 of the sequence of real-time electronic responses 144 (shown in FIG. 14) is in accordance with the predetermined characteristic firing signature 138 (shown in FIG. 12), the analog circuit 150 generates the laser initiation signal 71 (shown in FIG. 4) to initiate transmission of the laser 26. The predetermined characteristic firing signature 138 (shown in FIG. 12) is for the initial munition fired during automatic fire by the M240 machine gun and thus the controller 68 has detected that the sequence of real-time electronic responses 144 (shown in FIG. 14) correspond to an initial munition being fired by the M240 machine gun during the battle field training exercise. Another predetermined characteristic firing signature may be associated with the firing of subsequent munitions prior to the trigger release action and based on different munition firing events. The transfer function H ($x_a$, $y_a$, $z_a$) of the analog circuit may be designed so that the laser initiation signal 71 is initiated when sequences of real-time mechanical vibrations are in accordance with both the predetermined characteristic firing signature 138 (shown in FIG. 12) or the other predetermined characteristic firing signature associated with the firing of subsequent munitions from the firearm during automatic fire. Alternatively, another analog circuit in addition to the analog circuit of FIG. 15 may be provided with a transfer function H ($x_a$, $y_a$, $z_a$) specifically predetermined to detect the sequences of the other predetermined characteristic firing signature associated with the firing of subsequent munitions.

Those skilled in the art will recognize improvements and modifications to the preferred embodiments of the present disclosure. All such improvements and modifications are considered within the scope of the concepts disclosed herein and the claims that follow.

What is claimed is:

1. A laser transmission system mountable on a firearm, comprising:

a laser transmitter operable to transmit a laser;

a sensing apparatus operable to sense a sequence of real-time mechanical vibrations of the firearm;

a controller operably associated with the laser transmitter and the sensing apparatus, the controller being configured to:

detect that the sequence of real-time mechanical vibrations is in accordance with a predetermined characteristic firing signature of the firearm wherein the predetermined characteristic firing signature is based on a sequence of predetermined mechanical vibrations that result from a first pre-flash firing event and a subsequent second pre-flash firing event, which are each associated with a firing of a munition from the firearm;

generate a laser initiation signal upon detecting that the sequence of real-time mechanical vibrations is in accordance with the predetermined characteristic firing signature of the firearm, the laser initiation signal being operable to cause the laser transmitter to initiate transmission of the laser; and in response to detecting that the sequence of real-time mechanical vibrations is in accordance with the predetermined characteristic firing signature of the firearm, initiate transmission of the laser by sending the laser initiation signal to the laser transmitter.

2. The laser transmission system of claim 1 wherein the first pre-flash firing event comprises a trigger pull action that actuates a trigger of the firearm.

3. The laser transmission system of claim 2 wherein the subsequent second pre-flash firing event comprises one of either a chambering action that places the munition within a chamber of the firearm or a munition discharge action.

4. The laser transmission system of claim 1 wherein the subsequent second pre-flash firing event comprises one of either a chambering action that places the munition within a chamber of the firearm or a munition discharge action.

5. The laser transmission system of claim 1 wherein the munition comprises a blank munition, the firearm comprises an open-bolt machine gun, and the first pre-flash firing event and the subsequent second pre-flash firing event are each associated with the firing of the blank munition from the open-bolt machine gun.

6. The laser transmission system of claim 5, wherein:

the laser transmitter is operable to transmit the laser such that the laser comprises kill messages that are formatted in accordance with a Multiple Integrated Laser Engagement System (MILES), wherein MILES requires an adequate number of kill messages to be received from the laser transmitter for a laser receiver to register a kill;

the first pre-flash firing event comprises a trigger pull action that actuates a trigger of the open-bolt machine gun; and the subsequent second pre-flash firing event is sufficiently prior to a flash event in which a flash of the blank munition exits a barrel of the open-bolt machine gun such that initiating transmission of the laser by the laser transmitter provides sufficient time for the laser transmitter to transmit the adequate number of kill messages in the laser before the flash event.

7. The laser transmission system of claim 5, wherein after detecting that the sequence of real-time mechanical vibrations are in accordance with the predetermined characteristic firing signature and prior to a trigger return action:

the sensing apparatus is operable to sense a second sequence of real-time mechanical vibrations of the open-bolt machine gun;

the controller is configured to:

detect that the second sequence of real-time mechanical vibrations are in accordance with a second predetermined characteristic firing signature of the open-bolt machine gun wherein the second predetermined characteristic firing signature is based on a second sequence of predetermined mechanical vibrations that result from a flash event and a third pre-flash firing event prior to a second flash event in which a flash of a subsequent blank munition exits a barrel of the firearm; and in response to detecting that the second sequence of real-time mechanical vibrations are in accordance with the second predetermined characteristic firing signature of the open-bolt machine gun, again, initiating transmission of the laser by the laser transmitter.

8. The laser transmission system of claim 1, wherein:

the sensing apparatus is operable to sense the sequence of real-time mechanical vibrations of the firearm by generating a sequence of real-time electronic responses based on the sequence of real-time mechanical vibrations of the firearm; and the predetermined characteristic firing signature comprises a sequence of predetermined electronic responses based on the sequence of predetermined mechanical vibrations.

9. The laser transmission system of claim 8, wherein the controller is configured to detect that the sequence of real-time mechanical vibrations are in accordance with the predetermined characteristic firing signature of the firearm by detecting a first one of the sequence of real-time electronic responses at least as high as a first minimum amplitude level and, in response to detecting the first one of the sequence of real-time electronic responses, detecting a second one of the sequence of real-time electronic responses at least as high as a second minimum amplitude level and within a time period after the first one of the sequence of real-time electronic responses and wherein:

the first minimum amplitude level is based on the sequence of predetermined electronic responses that correspond to the sequence of predetermined mechanical vibrations resulting from the first pre-flash firing event;

the second minimum amplitude level is based on the sequence of predetermined electronic responses that correspond to the sequence of predetermined mechanical vibrations resulting from the subsequent second pre-flash firing event; and the time period is based on a temporal distance between the sequence of predetermined electronic responses that correspond to the sequence of predetermined mechanical vibrations resulting from the first pre-flash firing event and the sequence of predetermined electronic responses that correspond to the sequence of predetermined mechanical vibrations resulting from the subsequent second pre-flash firing event.

10. The laser transmission system of claim 9, wherein:

the first pre-flash firing event comprises a trigger pull action that actuates a trigger of the firearm; and the subsequent second pre-flash firing event comprises one of either a chambering action that places the munition within a chamber of the firearm and a munition discharge action that discharges the munition, whereby the second minimum amplitude level is higher than the first minimum amplitude level.

11. The laser transmission system of claim 1, wherein the controller is configured to detect that the sequence of real-time mechanical vibrations are in accordance with the predetermined characteristic firing signature of the firearm by:

detecting that at least a first real-time mechanical vibration from the sequence of real-time mechanical vibrations is in accordance with a first pre-flash characteristic firing event signature in the predetermined characteristic firing signature, the first pre-flash characteristic firing event signature corresponding to the sequence of predetermined mechanical vibrations that result from the first pre-flash firing event; and detecting that at least a second real-time mechanical vibration from the sequence of real-time mechanical vibrations is in accordance with a second pre-flash characteristic firing event signature in the predetermined characteristic firing signature, the second pre-flash characteristic firing event signature corresponding to the sequence of predetermined mechanical vibrations that result from the subsequent second pre-flash firing event.

12. The laser transmission system of claim 11, wherein:

the first pre-flash characteristic firing event signature is associated with a first vibrational level;

the second pre-flash characteristic firing event signature is associated with a second vibrational level, the second vibrational level higher than the first vibrational level;

the sensing apparatus comprising a piezoelectric sensor;

the controller is operable to adjust a vibrational sensitivity of the piezoelectric sensor to set a minimum vibrational level detectable by the controller;

wherein the controller is configured to detect that the at least the first real-time mechanical vibration from the sequence of real-time mechanical vibrations is in accordance with the first pre-flash firing event by setting the minimum vibrational level to the first vibrational level and the controller is configured to detect that the at least the second real-time mechanical vibration is in accordance with the second pre-flash characteristic firing event signature by setting the minimum vibrational level to the second vibrational level.

13. The laser transmission system of claim 12, wherein the controller is further configured to detect that the at least the second real-time mechanical vibration is in accordance with the second pre-flash characteristic firing event signature by determining that the at least the second real-time mechanical vibration occurs during a time period after the at least the first real-time mechanical vibration based on a temporal distance between the first pre-flash characteristic firing event signature and the second pre-flash characteristic firing event signature in the predetermined characteristic firing signature.

14. A method of initiating transmission of a laser from a laser transmitter mounted on a firearm, comprising:

sensing a sequence of real-time mechanical vibrations of the firearm;

detecting that the sequence of real-time mechanical vibrations is in accordance with a predetermined characteristic firing signature of the firearm wherein the predetermined characteristic firing signature is based on a sequence of predetermined mechanical vibrations that result from a first pre-flash firing event and a subsequent second pre-flash firing event, which are each associated with a firing of a munition from the firearm;

generating a laser initiation signal upon detecting that the sequence of real-time mechanical vibrations is in accordance with the predetermined characteristic firing signature of the firearm, the laser initiation signal being operable to cause the laser transmitter to initiate transmission of the laser; and initiating the transmission of the laser by sending the laser initiation signal to the laser transmitter in response to the detecting that the sequence of real-time mechanical vibrations is in accordance with the predetermined characteristic firing signature of the firearm.

15. The method of claim 14 wherein the first pre-flash firing event comprises a trigger pull action that actuates a trigger of the firearm.

16. The method of claim 15 wherein the subsequent second pre-flash firing event comprises one of either a chambering action that places the munition within a chamber of the firearm or a munition discharge action that discharges the munition.

17. A laser transmission system mountable on a firearm, comprising:

a laser transmitter operable to transmit a laser;

one or more accelerometers wherein the one or more accelerometers are operable to sense a sequence of real-time mechanical vibrations on the firearm along a first three orthogonal directions; and an analog controller operably associated with the one or more accelerometers and being configured to provide a transfer function, wherein the transfer function is provided such that the analog controller initiates transmission of the laser when the sequence of real-time mechanical vibrations is in accordance with a predetermined characteristic firing signature that is based on a sequence of predetermined mechanical vibrations along a second three orthogonal directions.

18. The laser transmission system of claim 17, wherein the first three orthogonal directions and the second three orthogonal directions are substantially the same.

19. The laser transmission system of claim 17, wherein the sequence of predetermined mechanical vibrations occur prior to a flash event.

20. A laser transmission system mountable on an open-bolt machine gun, comprising:

a laser transmitter operable to transmit a laser;

a sensing apparatus operable to sense a sequence of real-time mechanical vibrations of the open-bolt machine gun;

a controller operably associated with the laser transmitter and the sensing apparatus, the controller being configured to:

detect that the sequence of real-time mechanical vibrations is in accordance with a predetermined characteristic firing signature of the open-bolt machine gun wherein the predetermined characteristic firing signature is based on a sequence of predetermined mechanical vibrations that result from a first pre-flash firing event and a subsequent second pre-flash firing event, which are each associated with a firing of a blank munition from the open-bolt machine gun, the first pre-flash firing event comprising a trigger pull action that actuates a trigger of the open-bolt machine gun; and in response to detecting that the sequence of real-time mechanical vibrations is in accordance with the predetermined characteristic firing signature of the firearm, initiate transmission of the laser by the laser transmitter, wherein the laser transmitter is operable to transmit the laser such that the laser comprises kill messages that are formatted in accordance with a Multiple Integrated Laser Engagement System (MILES), wherein MILES requires an adequate number of kill messages to be received from the laser transmitter for a laser receiver to register a kill, the subsequent second pre-flash firing event being sufficiently prior to a flash event in which a flash of the blank munition exits a barrel of the open-bolt machine gun such that initiating transmission of the laser by the laser transmitter provides sufficient time for the laser transmitter to transmit the adequate number of kill messages in the laser before the flash event.

21. A laser transmission system mountable on an open-bolt machine gun, comprising:

a laser transmitter operable to transmit a laser;

a sensing apparatus operable to sense a first sequence of real-time mechanical vibrations of the open-bolt machine gun and a second sequence of real-time mechanical vibrations of the open-bolt machine gun; and a controller operably associated with the laser transmitter and the sensing apparatus, the controller being configured to:

detect that the first sequence of real-time mechanical vibrations is in accordance with a first predetermined characteristic firing signature of the open-bolt machine gun wherein the first predetermined characteristic firing signature is based on a first sequence of predetermined mechanical vibrations that result from a first pre-flash firing event and a subsequent second pre-flash firing event, which are each associated with a firing of a blank munition from the open-bolt machine gun; and in response to detecting that the first sequence of real-time mechanical vibrations is in accordance with the first predetermined characteristic firing signature of the open-bolt machine gun, initiate transmission of the laser by the laser transmitter;

detect that the second sequence of real-time mechanical vibrations is in accordance with a second predetermined characteristic firing signature of the open-bolt machine gun wherein the second predetermined characteristic firing signature is based on a second sequence of predetermined mechanical vibrations that result from a flash event and a third pre-flash firing event prior to a second flash event in which a flash of a subsequent blank munition exits a barrel of the firearm; and in response to detecting that the second sequence of real-time mechanical vibrations is in accordance with the second predetermined characteristic firing signature of the open-bolt machine gun, again, initiating transmission of the laser by the laser transmitter.

22. A laser transmission system mountable on a firearm, comprising:

a laser transmitter operable to transmit a laser;

a sensing apparatus operable to sense a sequence of real-time mechanical vibrations of the firearm by generating a sequence of real-time electronic responses based on the sequence of real-time mechanical vibrations of the firearm; and a controller operably associated with the laser transmitter and the sensing apparatus, the controller being configured to:

detect that the sequence of real-time mechanical vibrations is in accordance with a predetermined characteristic firing signature of the firearm wherein the predetermined characteristic firing signature comprises a sequence of predetermined electronic responses based on a sequence of predetermined mechanical vibrations that result from a first pre-flash firing event and a subsequent second pre-flash firing event, which are each associated with a firing of a munition from the firearm; and in response to detecting that the sequence of real-time mechanical vibrations is in accordance with the predetermined characteristic firing signature of the firearm, initiate transmission of the laser by the laser transmitter.

23. A laser transmission system mountable on a firearm, comprising:

a laser transmitter operable to transmit a laser;

a sensing apparatus operable to sense a sequence of real-time mechanical vibrations of the firearm; and a controller operably associated with the laser transmitter and the sensing apparatus, the controller being configured to:

detect that the sequence of real-time mechanical vibrations is in accordance with a predetermined characteristic firing signature of the firearm wherein the predetermined characteristic firing signature is based on a sequence of predetermined mechanical vibrations that result from a first pre-flash firing event and a subsequent second pre-flash firing event, which are each associated with a firing of a munition from the firearm, wherein the controller is configured to detect that the sequence of real-time mechanical vibrations are in accordance with the predetermined characteristic firing signature of the firearm by:

detecting that at least a first real-time mechanical vibration from the sequence of real-time mechanical vibrations is in accordance with a first pre-flash characteristic firing event signature in the predetermined characteristic firing signature, the first pre-flash characteristic firing event signature corresponding to the sequence of predetermined mechanical vibrations that result from the first pre-flash firing event; and detecting that at least a second real-time mechanical vibration from the sequence of real-time mechanical vibrations is in accordance with a second pre-flash characteristic firing event signature in the predetermined characteristic firing signature, the second pre-flash characteristic firing event signature corresponding to the sequence of predetermined mechanical vibrations that result from the subsequent second pre-flash firing event; and in response to detecting that the sequence of real-time mechanical vibrations is in accordance with the predetermined characteristic firing signature of the firearm, initiate transmission of the laser by the laser transmitter.

24. A method of initiating transmission of a laser from a laser transmitter mounted on a firearm, comprising:

sensing a sequence of real-time mechanical vibrations of the firearm by generating a sequence of real-time electronic responses based on the sequence of real-time mechanical vibrations of the firearm;

detecting that the sequence of real-time mechanical vibrations is in accordance with a predetermined characteristic firing signature of the firearm wherein the predetermined characteristic firing signature comprises a sequence of predetermined electronic responses based on a sequence of predetermined mechanical vibrations that result from a first pre-flash firing event and a subsequent second pre-flash firing event, which are each associated with a firing of a munition from the firearm; and initiating the transmission of the laser by the laser transmitter in response to the detecting that the sequence of real-time mechanical vibrations is in accordance with the predetermined characteristic firing signature of the firearm.

25. A method of initiating transmission of a laser from a laser transmitter mounted on a firearm, comprising:

sensing a sequence of real-time mechanical vibrations of the firearm;

detecting that the sequence of real-time mechanical vibrations is in accordance with a predetermined characteristic firing signature of the firearm wherein the predetermined characteristic firing signature is based on a sequence of predetermined mechanical vibrations that result from a first pre-flash firing event and a subsequent second pre-flash firing event, which are each associated with a firing of a munition from the firearm, wherein detecting that the sequence of real-time mechanical vibrations are in accordance with the predetermined characteristic firing signature of the firearm includes:

detecting that at least a first real-time mechanical vibration from the sequence of real-time mechanical vibrations is in accordance with a first pre-flash characteristic firing event signature in the predetermined characteristic firing signature, the first pre-flash characteristic firing event signature corresponding to the sequence of predetermined mechanical vibrations that result from the first pre-flash firing event; and detecting that at least a second real-time mechanical vibration from the sequence of real-time mechanical vibrations is in accordance with a second pre-flash characteristic firing event signature in the predetermined characteristic firing signature, the second pre-flash characteristic firing event signature corresponding to the sequence of predetermined mechanical vibrations that result from the subsequent second pre-flash firing event; and initiating the transmission of the laser by the laser transmitter in response to detecting that the sequence of real-time mechanical vibrations is in accordance with the predetermined characteristic firing signature of the firearm.

* * * * *